US008185021B2

(12) United States Patent
Katoh et al.

(10) Patent No.: US 8,185,021 B2
(45) Date of Patent: May 22, 2012

(54) DEVELOPING DEVICE AND IMAGE FORMING APPARATUS

(75) Inventors: Natsumi Katoh, Kanagawa (JP); Junichi Matsumoto, Kanagawa (JP); Tomoyuki Ichikawa, Kanagawa (JP); Nobuo Iwata, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/896,623

(22) Filed: Oct. 1, 2010

(65) Prior Publication Data

US 2011/0044726 A1 Feb. 24, 2011

Related U.S. Application Data

(62) Division of application No. 11/751,163, filed on May 21, 2007, now Pat. No. 7,835,653.

(30) Foreign Application Priority Data

May 25, 2006 (JP) ..... 2006-145523
May 25, 2006 (JP) ..... 2006-145527
Feb. 19, 2007 (JP) ..... 2007-037941
Feb. 19, 2007 (JP) ..... 2007-037943

(51) Int. Cl.
*G03G 15/08* (2006.01)

(52) U.S. Cl. ..... 399/254

(58) Field of Classification Search ..... 399/254, 399/258, 260, 92

See application file for complete search history.

(56) References Cited

U.S. PATENT DOCUMENTS 5,561,506 A * 10/1996 Kasahara ..... 399/256
5,797,074 A * 8/1998 Kasahara et al. ..... 399/262
6,345,163 B1 2/2002 Suzuki et al.
7,127,198 B2 10/2006 Muramatsu et al.
7,783,233 B2 8/2010 Iwata et al.
2003/0053826 A1* 3/2003 Bares et al. ..... 399/258
2003/0156859 A1 8/2003 Tamai
2004/0033088 A1 2/2004 Muramatsu et al.
2005/0254861 A1* 11/2005 Schlageter et al. ..... 399/258
2006/0002722 A1 1/2006 Murata
2007/0002182 A1 1/2007 Obayashi et al.

FOREIGN PATENT DOCUMENTS

JP 4-198966 7/1992
JP 5-21082 5/1993
JP 5-47957 6/1993
JP 7-225515 8/1995

(Continued)

OTHER PUBLICATIONS

Translation of Kasahara (JP Pub No. 07-225,515, Listed in IDS).

(Continued)

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A developing device includes a developing unit, a developer agitating unit, a developer conveying unit, and a toner supplementing unit. The developing unit develops an electrostatic latent image on an image carrier with a developer containing toner and carrier. The developer agitating unit agitates the developer. The developer conveying unit connects the developing unit and the developer agitating unit, and conveys the developer from the developing unit to the developer agitating unit. The toner supplementing unit is connected to the developer conveying unit, and supplements toner to the developer conveyed from the developing unit to the developer agitating unit.

11 Claims, 17 Drawing Sheets

FOREIGN PATENT DOCUMENTS

| | | |
|---|---|---|
| JP | 08-123198 | 5/1996 |
| JP | 10-177203 | 6/1998 |
| JP | 2002-91157 | 3/2002 |
| JP | 3349286 | 9/2002 |
| JP | 2003-122100 | 4/2003 |

OTHER PUBLICATIONS

U.S. Appl. No. 12/631,331.

Translation of Kasahara (JP Pub No. 07-225,515), Pub date Aug. 22, 1995.

U.S. Appl. No. 12/631,331, filed Dec. 4, 2009.

Office Action issued Oct. 11, 2011, in Japanese Application No. 2007-037941, filed Feb. 19, 2007, 2 pages.

Office Action issued Oct. 11, 2011, in Japanese Application No. 2007-037943, filed Feb. 19, 2007, 2 pages.

Office Action mailed Jan. 24, 2012, in Japanese Patent Application No. 2007-037941, filed Feb. 19, 2007.

* cited by examiner

DEVELOPING DEVICE AND IMAGE FORMING APPARATUS

CROSS-REFERENCE TO RELATED APPLICATIONS

The present application is a divisional of U.S. Ser. No. 11/751,163, filed May 21, 2007, now U.S. Pat. No. 7,835,653 and claims the benefit from Japanese priority documents, 2006-145523 filed in Japan on May 25, 2006, 2006-145527 filed in Japan on May 25, 2006, 2007-037941 filed in Japan on Feb. 19, 2007 and 2007-037943 filed in Japan on Feb. 19, 2007, each of which are incorporated herein by reference.

BACKGROUND OF THE INVENTION

1. Field of the Invention

The present invention relates to a developing device, and an image forming apparatus.

2. Description of the Related Art

In electrophotographic image forming apparatuses, such as copiers, printers, and facsimile machines, a developing device is used that visualizes or develops an electrostatic latent image on the surface of an image carrier, such as a photosensitive member, with two-component developer containing toner and carrier. In such a developing device, it is required to maintain a constant mixing ratio of carrier and toner of the developer and also appropriately control the charge amount of toner. In particular, when solid images, which consume a large amount of toner, are successively output, the large amount of supplied toner is left on a developing sleeve without being mixed with developer, thereby causing problems, such as toner flying and scumming (attachment of developer onto a non-image portion of a photosensitive member).

To overcome these problems, for example, Japanese Patent Application Laid-Open No. H10-177203 has proposed a conventional technology in which, before being supplied, toner is preliminarily agitated with a small amount of developer to be in a charging state to some degree, and then fed to an agitating unit.

Because the charge amount of toner is decreased with time, agitation performed twice is inefficient. In addition, two agitating portions are required, which increases the size of the apparatus. To overcome these drawbacks, Japanese Patent No. 3349286 discloses a developing device with a simple structure that controls the toner density and charge amount of the developer fed to the developing sleeve always within an appropriate range. The conventional developing device includes developing means that provides a developer with a toner and a carrier mixed therein to the image carrier and a developer optimizing unit for optimizing the developer. The developer optimizing unit is arranged separately from the developing means, and includes developer optimizing means having incorporated therein at least toner resupplying means and an agitating member for the toner and the carrier, and developer transporting and circulating means that transports the developer to the developing means and the developer optimizing means.

In the conventional developing device, toner is resupplied to a developer agitating unit to be mixed with a developer with a decreased toner density. However, because of the low specific gravity, the toner flies in the air or is left unmixed on the developer. Therefore, an agitating time may be long to make the toner density of the developer uniform. Also, when the developer agitating unit is resupplied with toner, there is a possibility that the resupplied toner may be mixed with the developer with an ideal toner density already achieved by agitation. Therefore, there is room for reconsidering agitation efficiency.

In a developer container containing two-component developer for the developing device, the toner is consumed through a developing operation. Therefore, the developing device is refilled with new toner, and the toner is conveyed together with carrier for dispersion. At this time, the toner and carrier are triboelectrically charged to cause an electric charge at the developer, thereby charging the toner. If the resupplied toner is not sufficiently dispersed or charged until the toner is supplied to the development roller, flying of charge-failed toner from the developing device may occur, thereby causing scumming on the image.

In particular, at a high-speed machine, a circulation speed of the developer in the developing device is fast. Therefore, a time for sufficiently charging the toner cannot be ensured. To get around this, to sufficiently charge the toner, the capacity of the developer is increased so that the resupplied toner is easy to be dispersed. However, the size of the developing device is increased, resulting in upsizing of the machine body. In view of this, Japanese Utility-Model Publication No. H5-21082 has proposed a conventional technology in which, in the developing device using two-component developer, developer agitating means is provided inside a photosensitive drum, and is connected to a developing unit with a pipe for circulation of the developer. Japanese Patent Application Laid-Open No. H4-198966 has proposed another conventional technology in which a developing unit and a developer agitating unit are separated in a developing device and these developing unit and developer agitating unit are connected together by developer circulating means. Japanese Patent Application Laid-Open No. H7-225515 has proposed another conventional technology in which a developing unit and a developer agitating unit in a developing device are connected together by developer circulating means and a screw pump is used for transporting the developer.

With the conventional technologies, a charge amount is adjusted in advance to a desired value by agitating toner and carrier outside a developing device. However, the charge amount of toner varies depending on various factors, and the charge amount may be different even with the same agitating conditions. For example, the factors include the surrounding environment (temperature and humidity), a decrease in charging capability of the carrier with time, and a change in toner charge amount due to an output image area, i.e., a difference in charge amount due to toner retention time, or the like. Moreover, due to the amount of toner newly resupplied, the charge amount may be varied, because mixing and agitating takes time if the amount of toner is large.

Therefore, in the conventional technologies, the charge amount is not constant depending on conditions, thereby affecting image quality. One scheme for solving such problems is to control an agitating force at a developer container outside the developing device to obtain an appropriate charge amount. However, agitation may exert stress on the developer, thereby accelerating deterioration of the toner and carrier.

SUMMARY OF THE INVENTION

It is an object of the present invention to at least partially solve the problems in the conventional technology.

According to an aspect of the present invention, a developing device includes a developing unit that develops an electrostatic latent image on an image carrier with a developer containing toner and carrier, a developer agitating unit that agitates the developer, a developer conveying unit that connects the developing unit and the developer agitating unit and conveys the developer from the developing unit to the developer agitating unit, and a toner supplementing unit that is connected to the developer conveying unit and supplements toner to the developer conveyed from the developing unit to the developer agitating unit.

According to another aspect of the present invention, a developing device includes a developing unit that develops an electrostatic latent image on an image carrier with a developer, a developer container that contains the developer, a developer supply member that connects the developer container and the developing unit, and a transporting unit that transports the developer from the developer container to the developing unit via the developer supply member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

The configuration and operation of a developing device according to a first embodiment of the present invention are explained referring to FIGS. 1 to 12.

Figure 1:
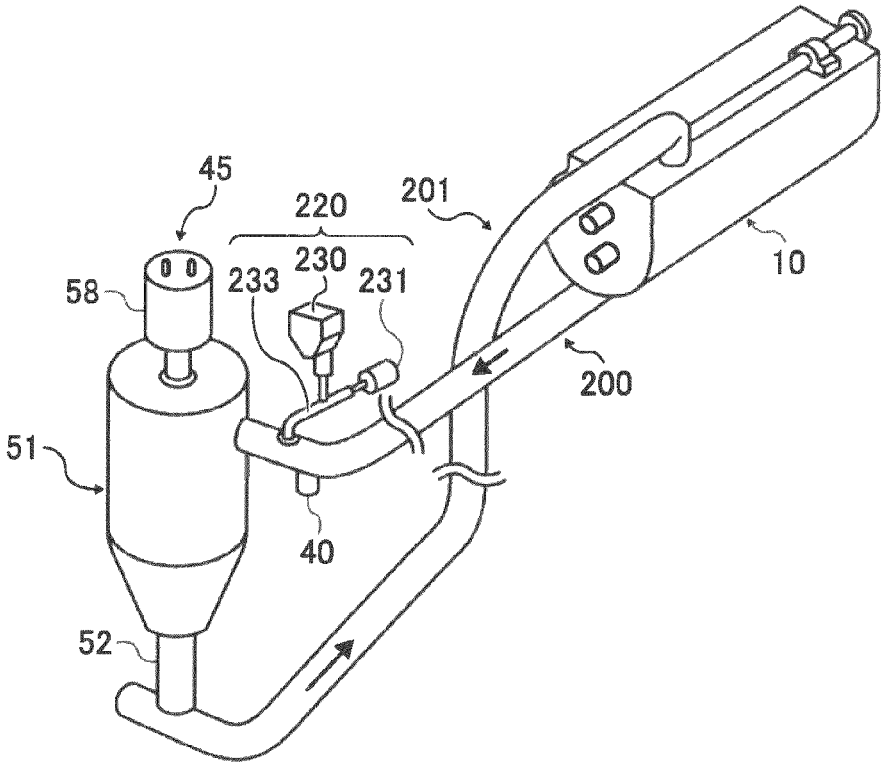
FIG. 1 is a perspective view of a developing device according to a first embodiment of the present invention.
Figure 2:
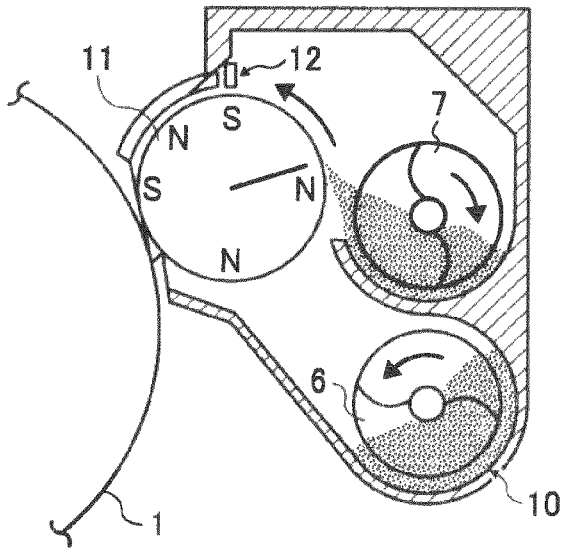
FIG. 2 is a longitudinal side view of a developing unit shown in FIG. 1.
Figure 3:
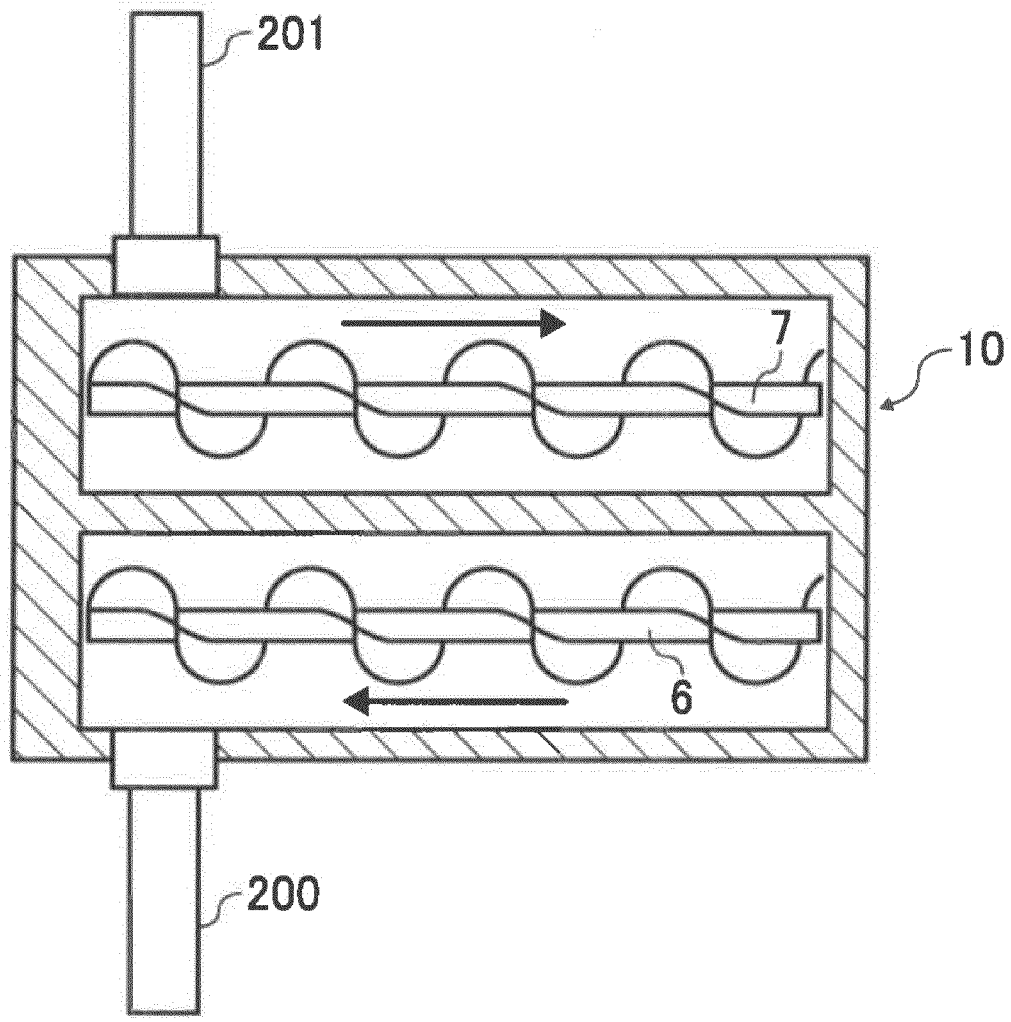
FIG. 3 is a longitudinal cross section of the developing unit.

As shown in FIG. 1, the developing device according to the first embodiment includes a developing unit 10, an agitating device 45, a developer conveying unit 200, a developer supplying unit 201, a toner supplementing unit 220, and a first toner density sensor 40.

The developing unit 10 develops an electrostatic latent image with a developer containing toner, and forms a toner image. The agitating device 45 agitates toner and carrier contained in the developer. The developer conveying unit 200 conveys the developer from the developing unit 10 to the agitating device 45. The developer supplying unit 201 transports the developer agitated by the agitating device 45 to the developing unit 10 for supply. The toner supplementing unit 220 supplements toner contained therein to the developer carried from the developing unit 10 to the agitating device 45. As in a general electrophotographic process, a toner image formed on a photosensitive drum 1, which is an image carrier arranged to face the developing unit 10, is transferred onto a transfer sheet, and is then fixed onto the transfer sheet by a fixing device for image output.

The first toner density sensor 40 measures a toner density of the developer.

The agitating device 45 mainly includes a motor 58, a developer container 51, an outlet 52. Details of the agitating device 45 are explained further below.

The toner supplementing unit 220 mainly includes a supplementary toner container 230, a toner supplement motor 231, and a toner supplement member 233. Details of the toner supplementing unit 220 are explained further below.

In the developer conveying unit 200, a toner supplement position of the toner supplementing unit 220 is, as shown in FIG. 1, on an upstream side of the agitating device 45 and on a downstream side of the developing unit 10. Therefore, the toner supplementing unit 220 supplements toner while the developer with its toner density decreased after development is transported from the developing unit 10 to the agitating device 45.

With conventional technologies, toner is directly supplemented to the developer conveyed to the agitating device 45. However, if toner is directly supplemented to the developer conveyed to the agitating device 45, lumps of supplementary toner fly in the agitating device 45 or are mixed with the developer already having an appropriate toner density. Therefore, it takes time until the developer has an appropriate toner density again, which reduces agitation efficiency.

To get around this problem, in the developing device according to the first embodiment, toner is directly supplemented to the developer with a decreased toner density before the developer is conveyed to the agitating device 45, whereby degradation in agitation efficiency is prevented at the agitating device 45. Compared with the case of directly supplementing toner to the developer conveyed to the agitating device 45, toner is directly supplemented to the developer with a decreased toner density and is mixed only with that developer. Therefore, the number of times of agitating until the toner density of the developer becomes appropriate can be reduced. Also, the number of times of agitating at the agitating device 45 is decreased, whereby stress imposed on the developer can be reduced and the toner density can be efficiently rendered uniform.

The developing unit 10 is a two-component developing unit, and contains a developer mixture of toner and carrier. As a developing scheme, a dry two-component developing scheme is used. In the dry two-component developing scheme according to the first embodiment, magnetic brush development is used. Alternatively, cascade development can be used.

The developing unit 10 includes a known developing roller 11 that is positioned to face the photosensitive drum 1 and is formed of a magnet and a sleeve to develop a latent image while keeping the developer on a roller surface by magnetic force to form a toner image, a screw-shaped supply member 7 for supplying the developer to the developing roller 11, a screw-shaped collecting member 6 that collects the developer from the developing roller 11, and a doctor 12, which is a developer regulating unit that causes the developer to have an appropriate layer thickness for supply to the photosensitive drum 1.

Figure 4:
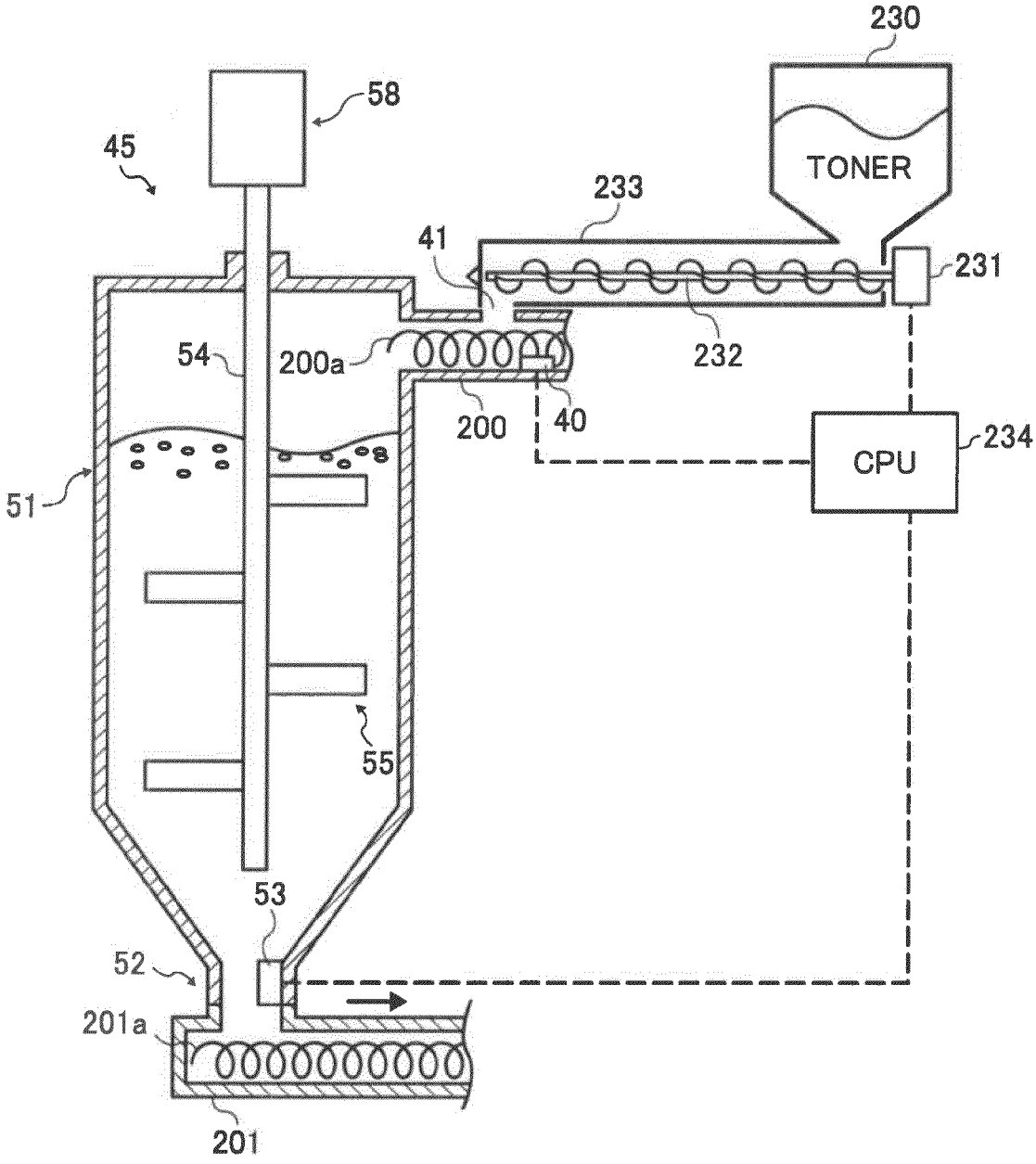
FIG. 4 is a longitudinal cross section of an agitating device shown in FIG. 1.

The developer conveying unit 200 is, as shown in FIG. 4, a pipe-shaped member connecting the collecting member 6 of the developing unit 10 and the agitating device 45, and is made of a material, such as metal, synthetic resin, or rubber. Rotatably arranged inside the developer conveying unit 200 is an auger 200*a* without shaft, along an extending direction of the developer conveying unit 200. The auger 200*a* has its one end connected to a driving shaft of a motor (not shown) as a driving source. Driven for rotation by this motor, the auger 200*a* conveys (transports) the developer from the developing unit 10 to the agitating device 45.

The developer supplying unit 201 is, as shown in FIG. 4, a pipe-shaped member connecting the agitating device 45 and the supply member 7 of the developing unit 10, and is made of a material, such as metal, synthetic resin, or rubber. Rotatably arranged inside the developer supplying unit 201 is an auger 201*a* without shaft, along an extending direction of the developer supplying unit 201. The auger 201*a* has its one end connected to a driving shaft of a motor (not shown) as a driving source. Driven for rotation by this motor, the auger 201*a* supplies the developer from the agitating device 45 to the developing unit 10.

Therefore, the developer transported from the developer supplying unit 201 to the developing unit 10 is supplemented from the upstream of the supply member 7, and is conveyed by the supply member 7 concurrently with the developing roller 11 to be supplied to the developing roller 11. This developer then is caused by the doctor 12 to have an optimum developer layer thickness for development. The developer after development is collected by the collecting member 6, and is then conveyed by the developer conveying unit 200 mounted at the bottom stream of the collecting member 6 to the agitating device 45 without being drawn up again to the developing roller 11.

The agitating device 45 is arranged separately from the developing unit 10, and has a function of making toner density and charge amount of the developer appropriate. The agitating device 45 has its upper portion connected to one end of the developer conveying unit 200 that supplies the developer, as shown in FIG. 4. Also, the agitating device 45 includes the developer container 51 provided at its lower portion with the outlet 52 that lets the developer out to the developer supplying unit 201. Approximately vertically arranged inside the developer container 51 is an agitator 54 that agitates the developer, and the agitator 54 is rotated by the external motor 58. The motor 58 is provided with a control circuit (not shown) for controlling (adjusting) the number of revolutions of the motor. The agitator 54 has mounted thereon a plurality of agitating blades 55, agitating the developer by the rotation of the agitating blades 55. The agitating operation can be controlled independently from transportation of the developer in a manner such that the number of times of agitation is increased when a large amount of toner is supplemented, whilst agitation is not performed when no toner is supplemented.

The outlet 52 is provided with a second toner density sensor 53 that detects the toner density of the developer in the agitating device 45. Based on the toner density detected by the second toner density sensor 53, toner supplement control is performed by the control circuit.

The control circuit includes a central processing unit (CPU), a read only memory (ROM), and a random access memory (RAM). The CPU uses the RAM as a work area and executes a computer program stored in the ROM, thereby implementing the operation of the first embodiment. The developer guided by the developer conveying unit 200 to the inside of the developer container 51 of the agitating device 45 is mixed and agitated by the agitating blades 55. With this, the charge amount and the toner density are made appropriate. Then, the developer is sent to the developer supplying unit 201.

Figure 5:
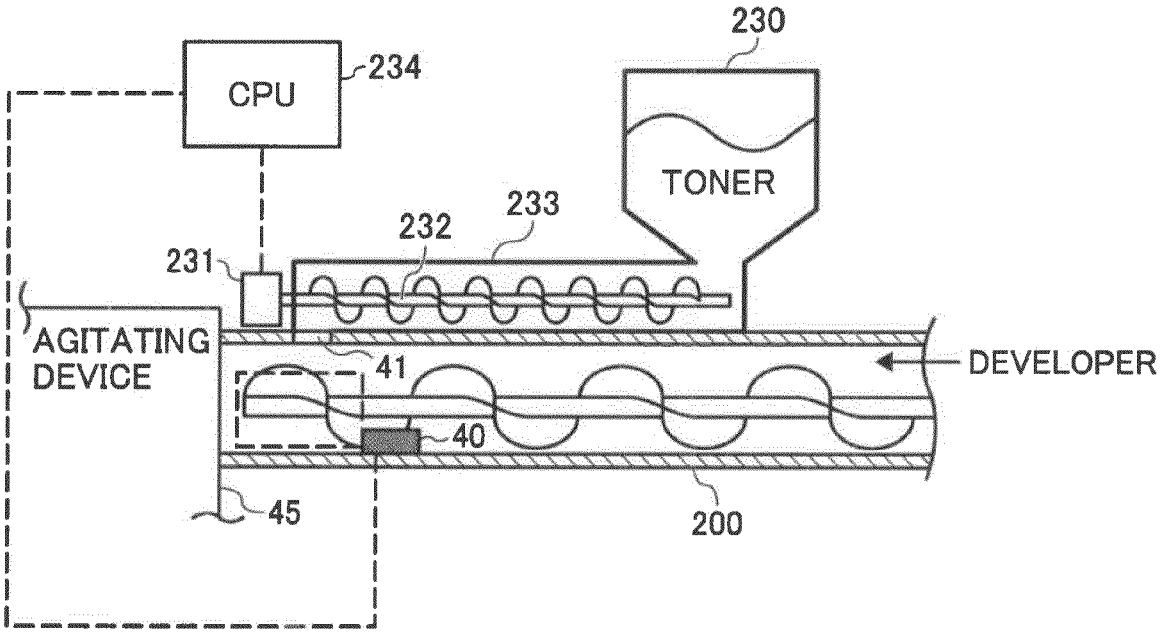
FIG. 5 is a schematic diagram of a connecting portion between a toner supplement opening and a developer carrying member (developer circulating member) shown in FIG. 3.

The toner supplementing unit 220 supplements toner to the developer conveyed to the developer container 51, and is connected to the developer conveying unit 200, as shown in FIGS. 4 and 5.

In more detail, the toner supplement member 233 has one end connected to a lower portion of the supplementary toner container 230, and the other end connected to a toner supplement hole 41 formed as an opening by boring the developer conveying unit 200 near the developer container 51. The toner supplement member 233 is provided therein with a coil screw 232 rotating by the toner supplement motor 231. By the rotation of the coil screw 232, the toner is conveyed from the supplementary toner container 230 to the toner supplement hole 41. The toner conveyed to the toner supplement hole 41 is poured into the developer conveying unit 200 from the toner supplement hole 41, and is then conveyed by the rotation of the auger 200*a* provided inside the developer conveying unit 200 to the developer container 51. With this, the toner supplementing unit 220 supplements the toner to the developer conveyed from the developing unit 10 to the agitating device 45.

Besides, as shown in FIG. 4, the first toner density sensor 40 is provided on an upstream side of the toner supplement hole 41 of the developer conveying unit 200 to measure the toner density of the developer. Toner supplement from the toner supplementing unit 220 is performed according to the toner density of the developer detected by the first toner density sensor 40. With this, the toner density of the developer after agitation is made uniform.

As for the developer after development, the toner density is first detected by the first toner density sensor 40 and, based on the detection result, the toner supplement amount is determined. Toner having an amount equivalent to the determined supplement amount is supplemented when the developer passing through the first toner density sensor 40 then passes an area provided with the toner supplement hole 41. Preferably, the first toner density sensor 40 is located near the toner supplement hole 41 to increase the effect of supplementing the toner according to the detected toner density of the developer. However, if a distance between the toner supplement hole 41 and the first toner density sensor 40 is too short, the first toner density sensor 40 may detects the toner density of the developer supplemented with the toner. To get around this, an area over which the toner supplemented from the toner supplement hole 41 spreads is measured in advance, and the first toner density sensor 40 is arranged at a position outside of the area (indicated by a dotted line in FIG. 5) immediately upstream in a developer conveying direction. With this, the possibility that the first toner density sensor 40 may detect the density of the developer supplemented with toner is eliminated. Therefore, an appropriate amount of toner can be supplemented from the toner supplement hole 41.

As for the position of the toner supplement hole 41, if the developer conveying unit 200 is long and the toner supplement hole 41 is arranged on an upstream side of the developer conveying unit 200, inconveniences may occur such that the toner will build up during conveyance or the toner to be mixed and the developer will be separated, because of a fluidity difference between lumps of toner and the developer. To get around such inconveniences, the toner supplement hole 41 is preferably positioned on a downstream side as much as possible on the developer conveyer path so that the toner is mixed with the developer by the agitating device 45 immediately after the toner is supplemented.

Explained next is the operation of the toner supplementing unit 220 for supplementing toner to the developer. In the developing unit 10, the developer after development is collected by the collecting member 6, and is then guided by the developer conveying unit 200 to the agitating device 45.

In the first embodiment, the first toner density sensor 40 detects a change in magnetic permeability of the two-component developer, thereby detecting a change in toner density. As shown in FIG. 5, upon receiving a detection signal from the first toner density sensor 40, the known control circuit (CPU 234) that detects the toner density calculates a toner supplement period according to the toner density detected. The toner supplement motor 231 is driven and controlled based on the calculation result of the CPU 234 to drive the coil screw 232. With the coil screw 232 being driven, the amount of toner corresponding to the calculated toner supplement period is supplied to the area indicated by the dotted line in the developer conveying unit 200. In FIGS. 4 and 5, the position of the toner supplement motor 231 is reversed. However, these drawings each depict a schematic configuration for explaining the toner supplement function. Therefore, needless to say, the toner supplement motor 231 may be provided on either side.

Figure 6:
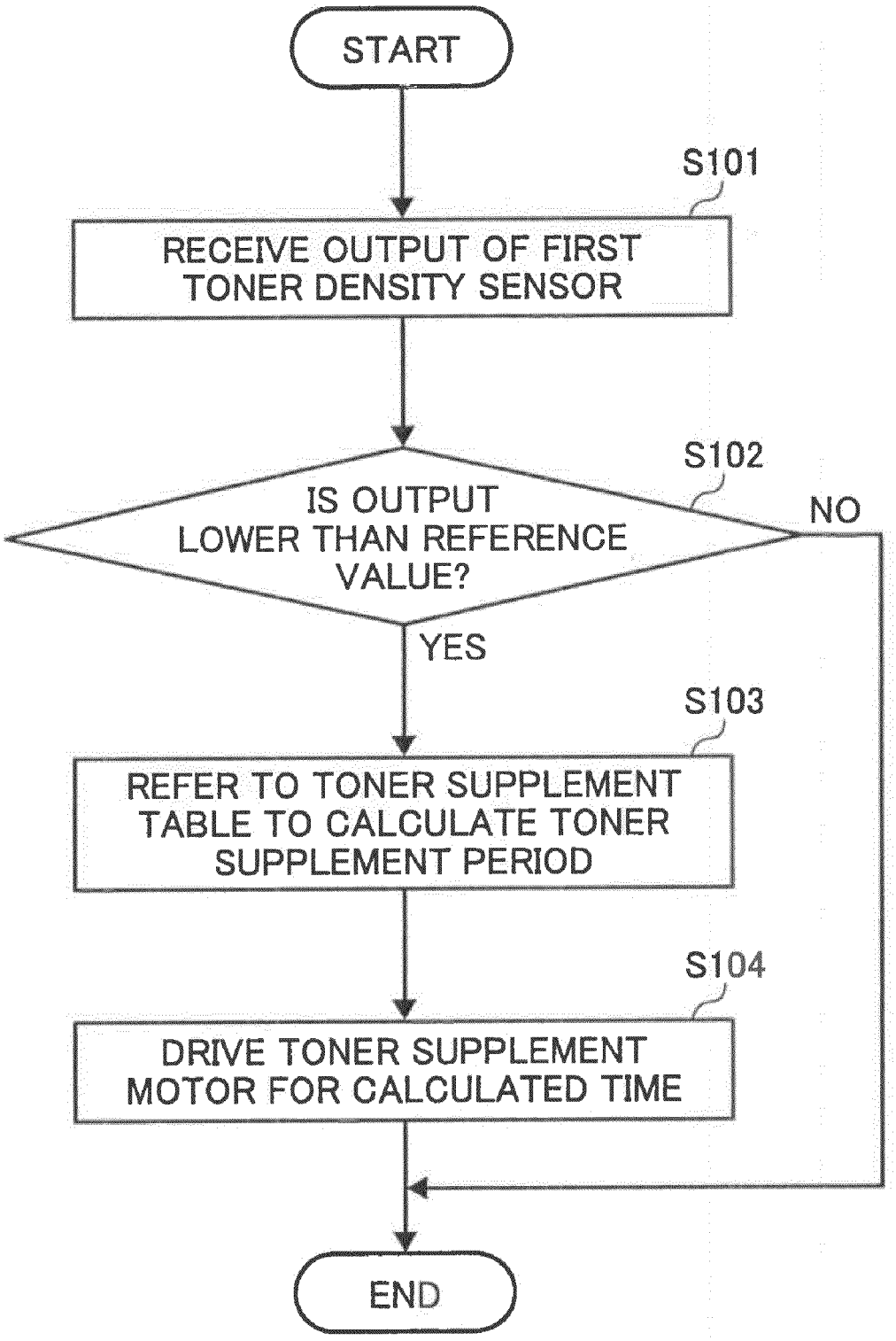
FIG. 6 is a flowchart of a process procedure for supplementing toner based on output from a first toner density sensor shown in FIG. 1.

FIG. 6 is a flowchart of a process procedure for supplementing toner based on output from the first toner density sensor 40. The output (represented by voltage) of the first toner density sensor 40 has a correlation represented by a constant curve of the second order inversely proportional to the toner density, and a toner supplement table indicating a toner supplement period (rotation time of the toner supplement motor 231) based on this correlation is stored in memory of the CPU 234. Thus, in this procedure, upon start of a developing operation, the CPU 234 receives output of the first toner density sensor 40, i.e., toner density detected by the first toner density sensor 40, via the detection circuit (step S101). The CPU 234 compares toner density with a reference value each time it receives output of the first toner density sensor 40 (step S102). When the toner density is lower than the reference value (YES at step S102), the CPU 234 refers to the toner supplement table, and calculates a toner supplement period (step S103). Then, the CPU 234 drives the toner supplement motor 231 for the calculated toner supplement period (step S104), and supplements toner through the coil screw 232. The CPU 234 can also be used as the CPU that constitutes the control circuit of the motor 58. When the toner density is equal to or higher than the reference value (NO at step S102), toner is not supplemented from the toner supplementing unit 220, and the CPU 234 waits until the next sensor output is received.

Figure 7:
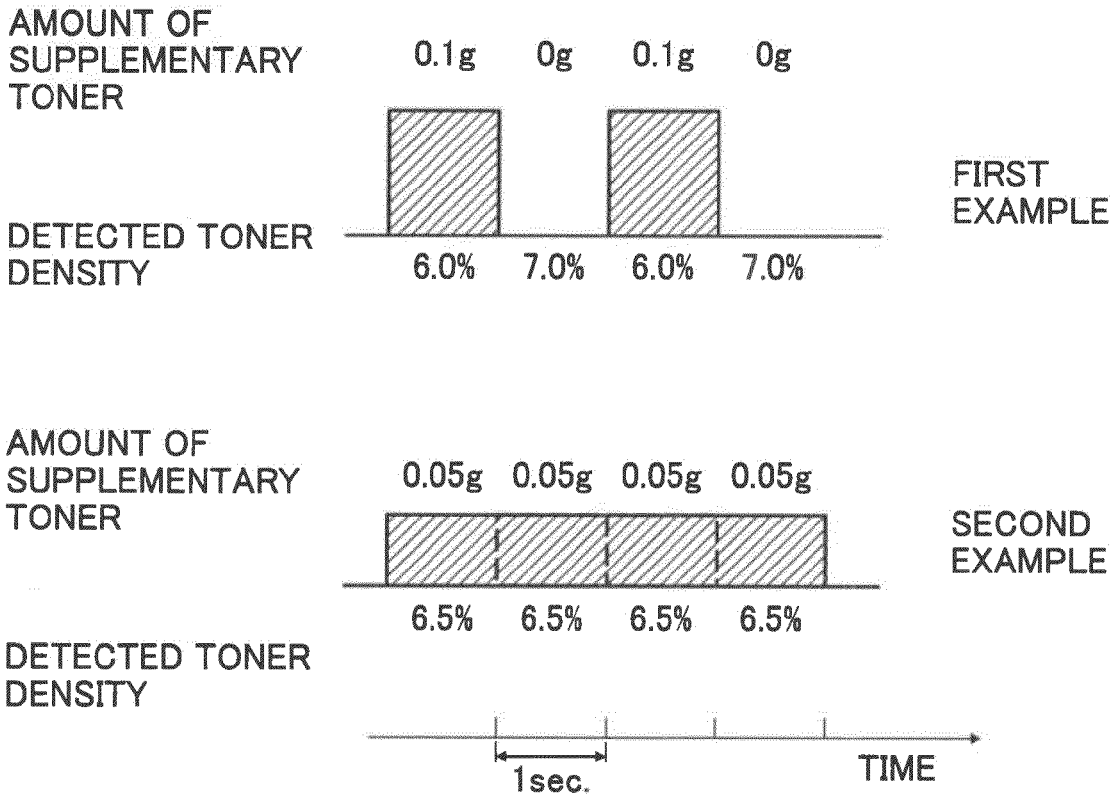
FIG. 7 is a schematic diagram for explaining a specific example of toner supplement.

FIG. 7 is a schematic diagram for explaining a specific example of toner supplement. In FIG. 7, in the first example, the first toner density sensor 40 notifies the CPU 234 of toner density of developer at intervals of 1 second. Provided that the amount of the developer transported for 1 second is 10 grams and that an appropriate toner density of the developer is 7 weight percent, when 6 weight percent of toner density is detected at a certain time, 0.1 gram of toner is supplemented to the developer. When 0.1 gram of toner is mixed with 10 grams of the developer with a toner density of 6 weight percent by the agitating device 45, developer with a toner density of 7 weight percent is obtained. One second later, the developer with a toner density of 7 weight percent passes over the first toner density sensor 40. At this point, the toner density is appropriate, and thus, toner is not supplemented. On the other hand, in the second example, 0.05 gram of toner is continuously supplemented at intervals of 1 second. The density detection and toner supplement operation is repeated at intervals of 1 second, and the toner and the developer are transported to the agitating device 45 to always generate 7 weight percent when agitated. In the first embodiment, toner supplement is performed not for the purpose of increasing overall toner density of the developer being conveyed, but for the purpose of increasing the toner density of the developer passing over the first toner density sensor 40 at 1 second.

Also in toner supplement control at a conventional developing device, the amount of supplementary toner is controlled according to the toner density measured by a toner density sensor provided in the developing device. However, the conventional developing device supplements toner by detecting a decrease in toner density of the overall developer circulating inside the device. That is, the supplementary toner increases the toner density of the developer circulating through the entire device, thereby adjusting the toner density at a target density. Therefore, the toner density may be somewhat uneven. On the other hand, according to the first embodiment, the toner density of the developer collected from the developing unit 10 is measured, and toner is supplemented as appropriate to the collected developer according to the measured toner density. Therefore, local density unevenness tends not to occur, and the accuracy of toner supplement is high.

As for the output of the toner density sensor, when the environment or the bulk density of developer is changed, output voltage is fluctuated even in developers with the same toner density. For this reason, to suppress such an influence, it is desirable to combine another unit that estimates toner density of the developer. For example, the number of dots written on the photosensitive drum 1 is counted and integrated, the toner density of the developer is estimated from the result, and then the amount of supplement is determined by referring to the output of the first toner density sensor 40. With this, fluctuations in the amount of supplement due to the environment can be avoided. Also, more accurate toner supplement control can be performed. The number of written dots can be counted and integrated by, as with conventional technologies, the CPU of the control circuit explained above or the CPU 234, for example.

Figure 8:
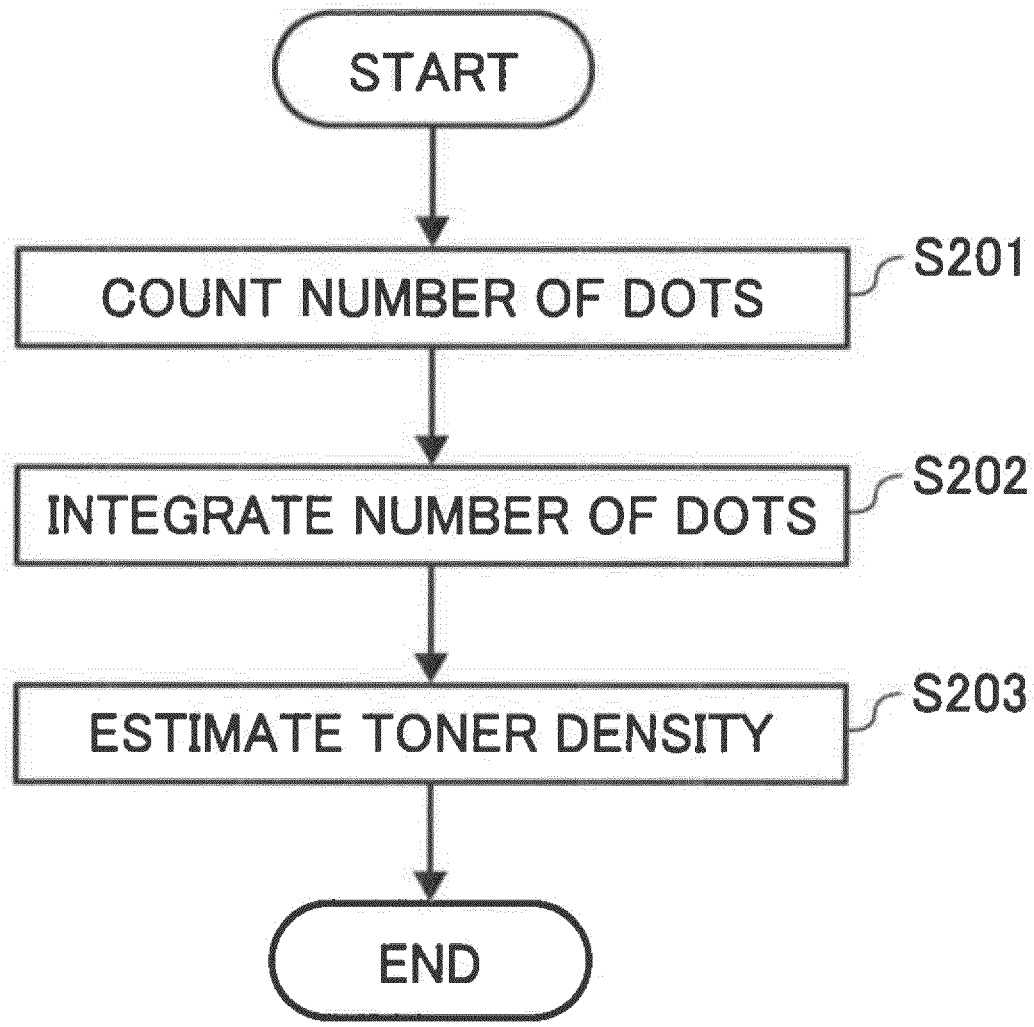
FIG. 8 is a flowchart of a process procedure of integrating the number of dots.

In a dot-number integrating process shown in FIG. 8, first, the number of dots is counted (step S201) and is then integrated (step S202) to estimate toner density (step S203).

Figure 9:
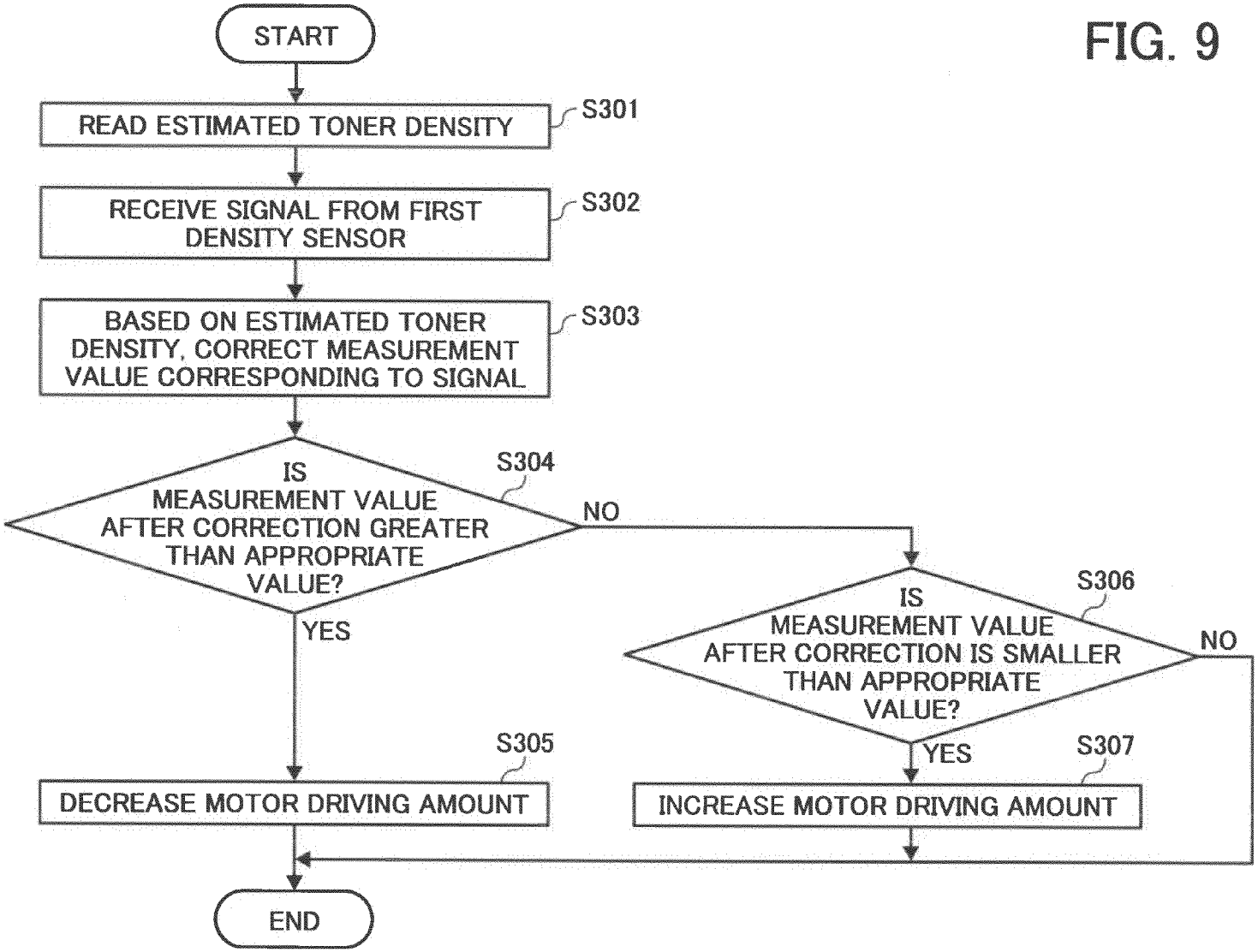
FIG. 9 is a flowchart of a process procedure for supplementing toner based on a result obtained through the process shown in FIG. 8.

In toner supplement process shown in FIG. 9 using the result of the dot-number integrating process, the CPU first reads the estimated toner density (step S301). Next, upon receiving a signal from the first toner density sensor 40 (step S302), the CPU corrects a measurement value corresponding to the signal received from the first toner density sensor 40 based on the estimated toner density (step S303). Next, the CPU compares the measurement value after correction and a preset appropriate value. If the measurement value is greater than the appropriate value (YES at step S304), the CPU decreases the motor driving amount (step S305). If the measurement value is not greater than the appropriate value, the CPU further compares the measurement value after correction and the appropriate value. If the measurement value is smaller than the appropriate value (YES at step S306), the CPU increases the motor driving amount (step S307). If the measurement value is not smaller than the appropriate value, i.e., if the measurement value is equal to the appropriate value, toner supplement is performed with the same motor driving amount.

However, even with the control explained above, as the toner residual amount in the supplementary toner container 230 is decreased, the supplement amount may be changed. If the amount of supplementary toner from the supplementary toner container 230 is not accurately controlled, the toner density of the developer cannot be maintained appropriately. To get around this problem, as shown in FIG. 4, the second toner density sensor 53 is provided at a lower portion of the agitating device 45. With the second toner density sensor 53, the toner density of the developer in the agitating device 45 is detected and, based on the detected toner density, toner supplement control is performed.

Figure 10:
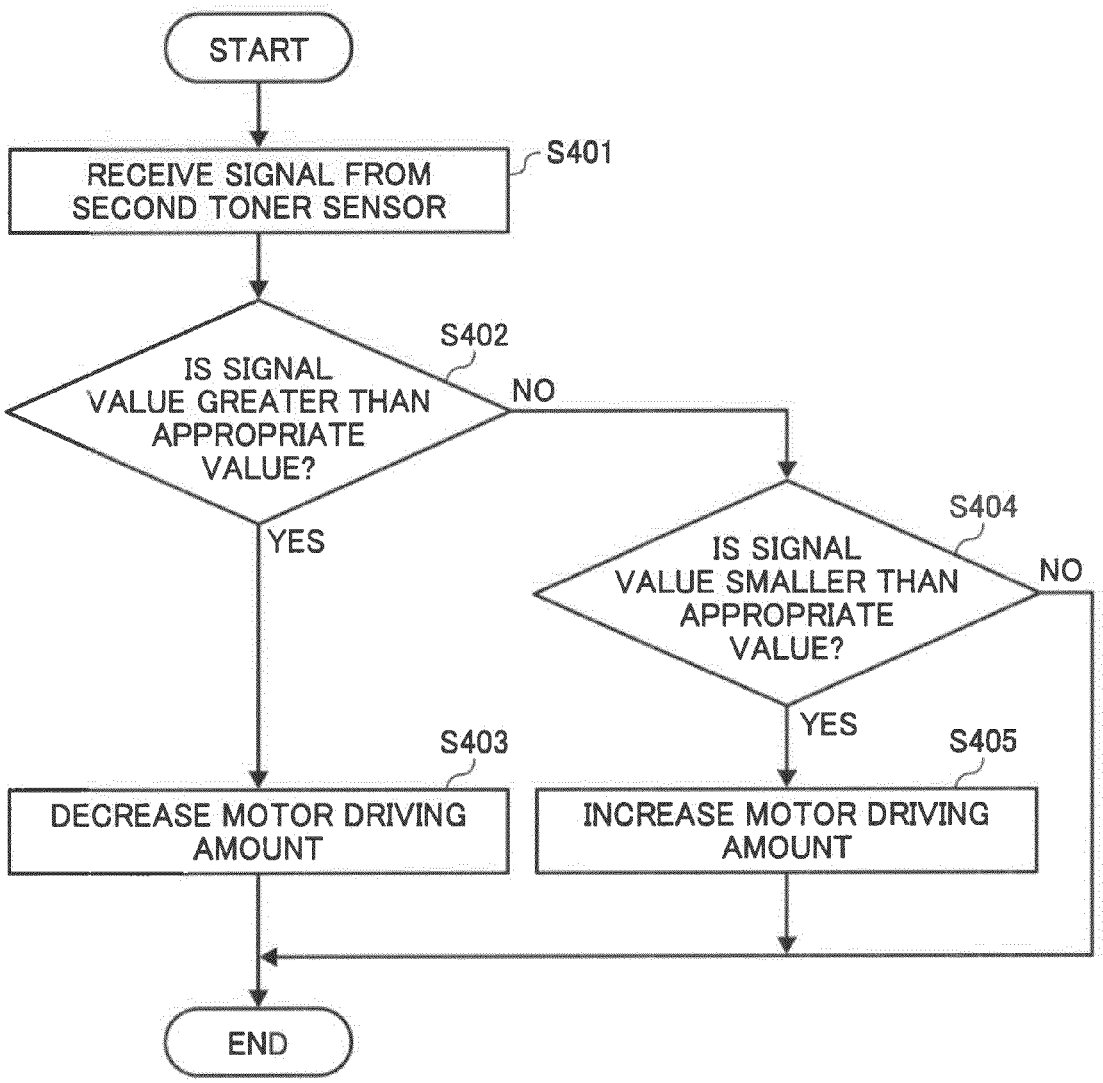
FIG. 10 is a flowchart of a process procedure for supplementing toner based on output from a second toner density sensor shown in FIG. 4.

FIG. 10 is a flowchart of a process procedure for supplementing toner based on output from the second toner density sensor 53. First, the CPU receives a detection signal from the second toner density sensor 53 (step S401), and then compares the signal value of the detection signal (measurement value) and an appropriate value. If the signal value is greater than the appropriate value (YES at step S402), The CPU decreases the motor driving amount (step S403). If the signal value is not greater than the appropriate value, The CPU further compares the signal value and the appropriate value. If the signal value is smaller than the appropriate value (YES at step S404), The CPU increases the motor driving amount (step S405). If the signal value is not smaller than the appropriate value, i.e., if the signal value is equal to the appropriate value, toner supplement is performed with the same motor driving amount.

That is, if the toner density is smaller than the appropriate value, it is determined that the toner supplement amount is not sufficient, and then a signal is sent to the toner supplement motor 231 that controls the toner supplement amount to increase the supplement amount. On the contrary, if the toner density is greater than the appropriate value, it is determined that the toner supplement amount is too large, and control is performed to decrease the toner supplement amount. Through such control, even the case where the toner supplement amount is varied can be supported, and fluctuations in toner density discharged from the agitating device 45 can be suppressed.

The density of the developer may also be smaller than the appropriate value when the supplementary toner enters an area, such as a corner of the agitating device 45, where agitation cannot be performed. Even in such cases, the second toner density sensor 53 detects that the toner density in the agitating device 45 is smaller than the reference value, and thereby toner is added to the developer.

Figure 11:
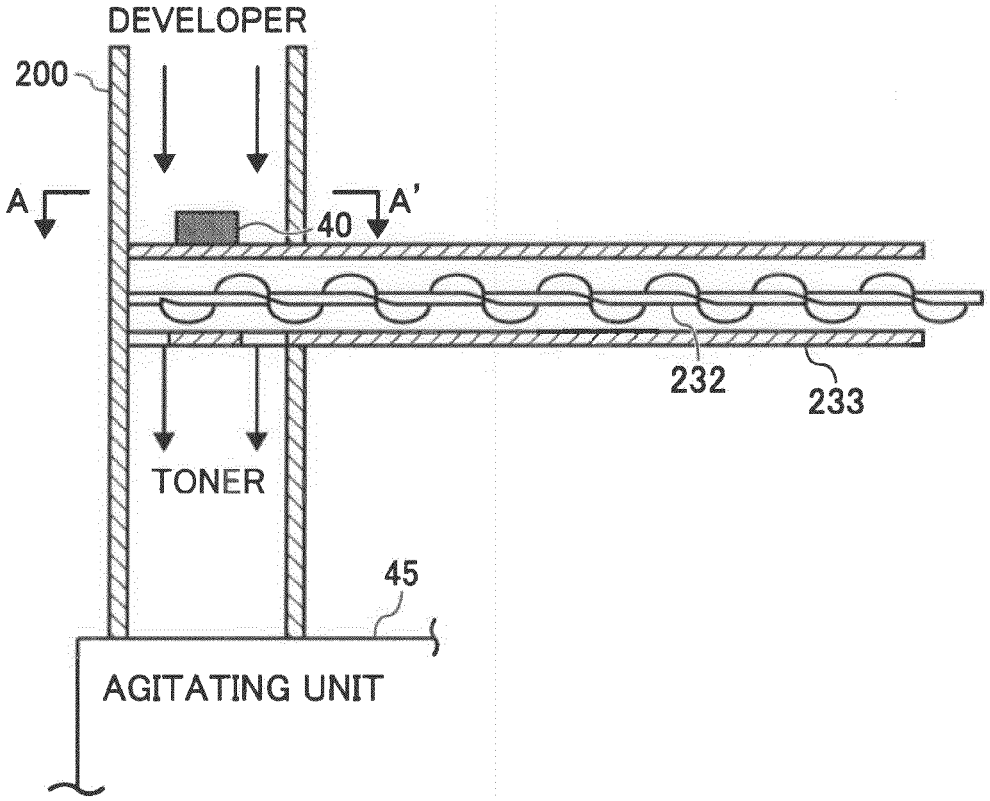
FIG. 11 is a cross section of an example of a developer conveying unit in which a toner supplement direction is changed.
Figure 12:
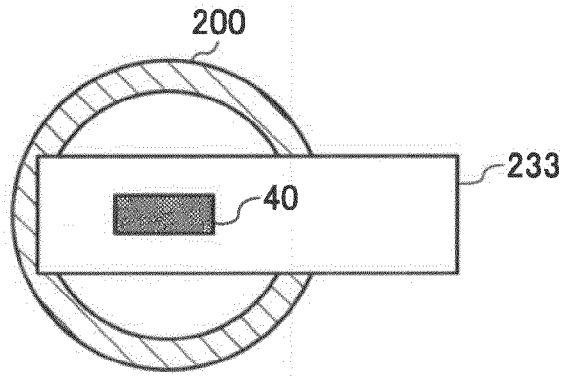
FIG. 12 is a cross section taken along the line A-A' of FIG. 11.

Furthermore, as shown in FIGS. 11 and 12, when a toner supplement direction is identical to a developer conveying direction, in the developer conveying unit 200, transport is performed in the order of developer, toner, developer, toner, . . . after a toner supplement hole. Since the developer and the toner desired to be mixed together are transported in combination, the possibility that the supplementary toner is agitated and mixed with another developer is low.

That is, when the position of toner supplement by the toner supplement member 233 is set in a path of the developer conveying unit 200 where the developer flows from top to bottom, heavy developer can be superposed after toner supplement on light toner. Therefore, an effect of mixing the developer and the supplementary toner can be expected. Also, an effect of preventing the toner from flying upward can be achieved. The agitating device 45 is arranged at a position different from that of the developing unit, but is not necessarily far away therefrom.

Figure 13:
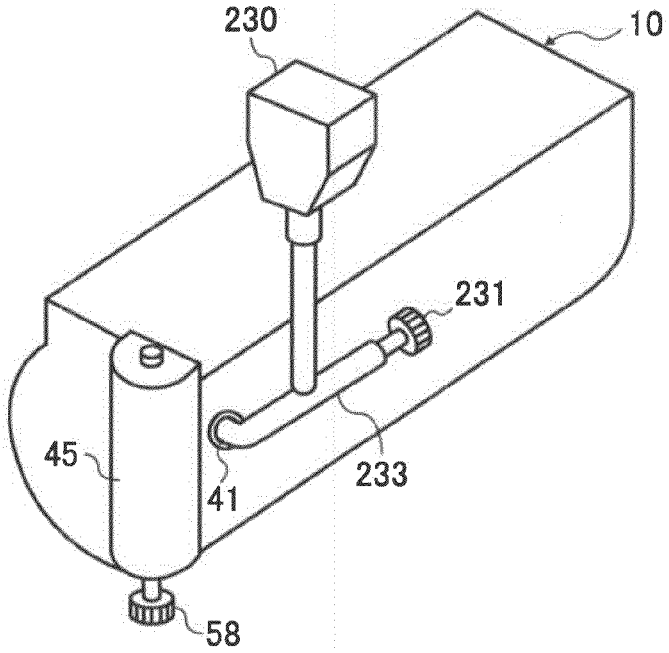
FIG. 13 is a perspective view of a developing device according to another embodiment of the present invention.
Figure 14:
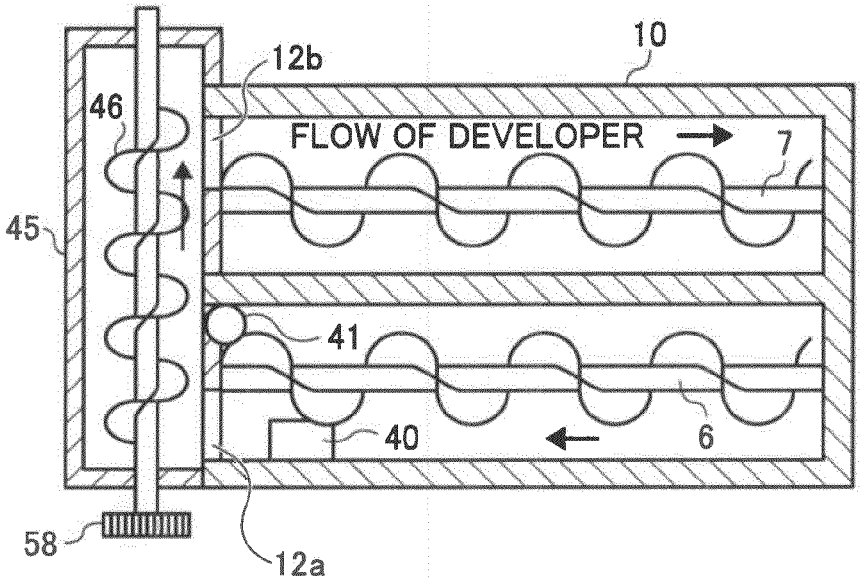
FIG. 14 is a cross section of a developing unit shown in FIG. 13.

Next, the configuration of a developing device according to a second embodiment is explained referring to FIGS. 13 and 14. In the second embodiment, the agitating device 45 is provided on a side surface of the developing unit 10. The developing device according to the second embodiment is similar to the developing device according to the first embodiment in that the developing unit 10 and the agitating device 45 are separately configured. However, in the second embodiment, the agitating device 45 is immediately near the developing unit 10, and therefore the developer conveying path is short, which is a different point from the developing device according to the first embodiment. Described below is such a structure different from the first embodiment.

The agitating device 45 and the developing unit 10 are connected via a lower passing portion 12*a* and an upper passing portion 12*b*. Even without setting a transport member, such as a screw, the developer is forcefully pressed by the following developer for conveyance. The developer after development is over is passed via the lower passing portion 12*a* from the collecting member 6 to the agitating device 45. The developer discharged from the agitating device 45 is discharged via the upper passing portion 12*b* onto the supply member 7, and thus circulated. That is, the upper passing portion 12*b* and the lower passing portion 12*a* serve as a developer conveying path. In the second embodiment, the agitating device 45 includes a screw 46 as an agitating member.

When the developer conveying path is short (or does not almost exist), it is difficult to set both of a toner density detecting member and the toner supplement hole on the developer conveying path. As such, the first toner density sensor 40 and the toner supplement hole 41 are provided on a conveying path on which developer is conveyed by the collecting member 6, and toner density detection and toner supplement are performed at a position immediately before the developer is conveyed to the agitating device 45. That is, to measure all densities of the developer after development is over, the first toner density sensor 40 is provided after all developers are collected from the developing roller 11, i.e., at a most downstream position of the screw forming the collecting member 6. In more detail, in the developing device according to the second embodiment, the toner density is measured before the developer is conveyed to the agitating device 45, and toner is then supplemented from the toner supplement hole 41 according to the measured toner density. Therefore, at an entrance of the agitating device 45, the density of the toner contained in the developer has been conveyed with a predetermined density. Thus, an effect equivalent to that in which toner is supplemented into the developer conveying path can be achieved. Note that the developer after development is over does not go up again to the developing roller 11 from the collecting member 6.

Next, the configuration and operation of a developing device according to a third embodiment is explained based on FIGS. 2 and 15 to 18.

Figure 15:
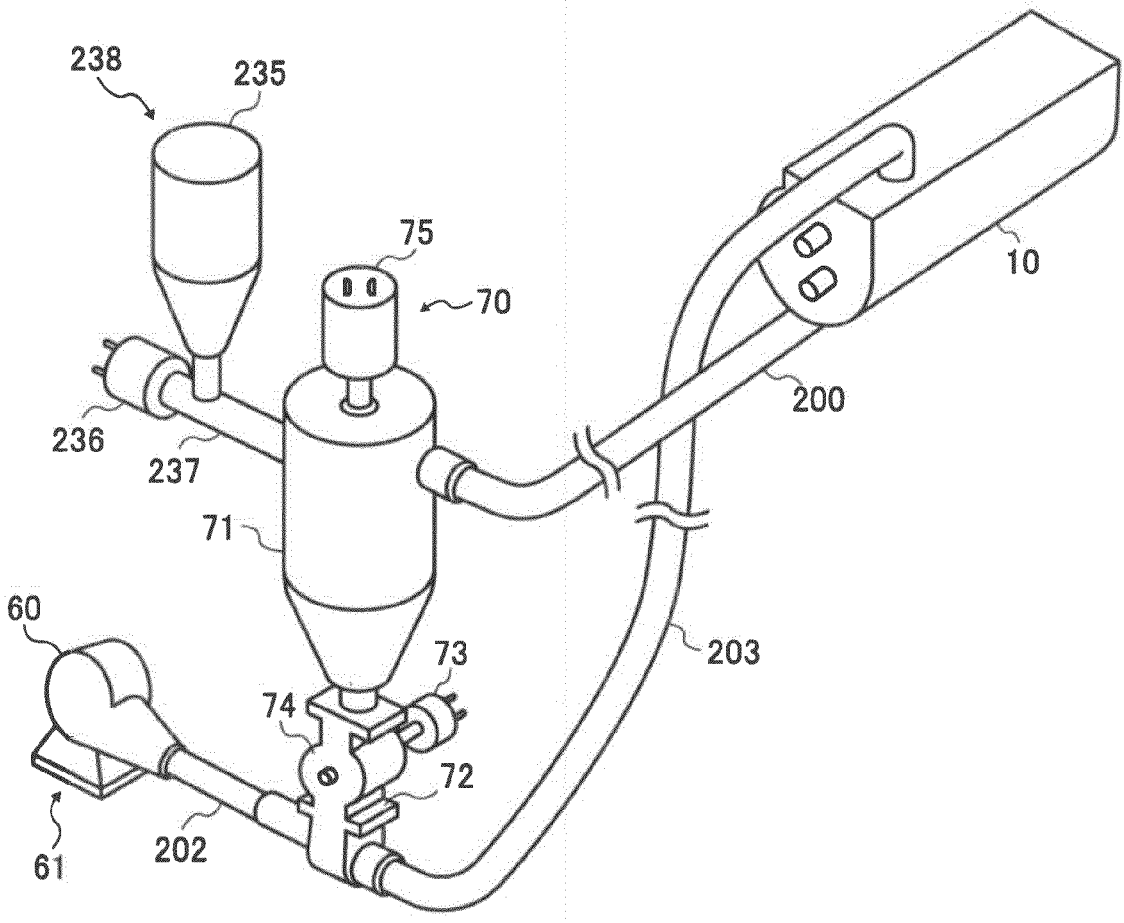
FIG. 15 is a perspective view of a developing device according to still another embodiment of the present invention.

As shown in FIG. 15, the developing device according to the third embodiment includes the developing unit 10, an agitating device (developer container) 70, the developer conveying unit 200, a toner supplementing unit 238, a developer supply member 203, and a transporting unit 61.

The developing unit 10 develops an electrostatic latent image with a developer containing toner and forms a toner image. The agitating device 70 contains the developer and agitates toner and carrier contained in the developer. The developer conveying unit 200 conveys the developer inside the developing unit 10 to the agitating device 70. The toner supplementing unit 238 supplements toner contained therein to the developer carried from the developing unit 10 to the agitating device 70. The developer supply member 203 connects the agitating device 70 and the developing unit 10. The transporting unit 61 transports, to the developing unit 10, the developer discharged from the agitating device 70 to the developer supply member 203, and generates an electric charge at the developer being transported. As in a general electrophotographic process, a toner image formed on a photosensitive drum, which is an image carrier arranged to face the developing unit 10, is transferred onto a transfer sheet, and is then fixed onto the transfer sheet by a fixing device for image output.

The agitating device 70 includes a motor 75, a developer container 71, a feeder 74, and a discharge outlet 72. Details of the agitating device 70 are explained further below.

The toner supplementing unit 238 includes a supplementary toner container 235, a toner supplement motor 236, and a toner supplement member 237. Details of the toner supplementing unit 238 are explained further below.

The transporting unit 61 includes an air blower 60 and an air supply member 202. The transporting unit 61 blows air from the air blower 60 via the air supply member 202 to the developer supply member 203, thereby transporting the developer discharged from the agitating device 70 to the developing unit 10 via the developer supply member 203 and also causing an electric charge at the developer being transported. Details of the transporting unit 61 are explained further below.

The developing unit 10 is a two-component developing unit, and contains a developer mixture of toner and carrier. As a developing scheme, a dry two-component developing scheme is used. In the dry two-component developing scheme according to the third embodiment, magnetic brush development is used. Alternatively, cascade development can be used.

The developing unit 10 includes the developing roller 11, a supply member 7, the screw-shaped collecting member 6, and the doctor 12. The developing roller 11 is arranged to face the photosensitive drum 1 and develops an electrostatic latent image while keeping the developer on a roller surface by magnetic force to form a toner image. The supply member 7 supplies the developer to the developing roller 11. The screw-shaped collecting member 6 collects the developer from the developing roller 11. The doctor 12 is a developer regulating unit that causes the developer to have an appropriate layer thickness for supply to the photosensitive drum 1.

Figure 17:
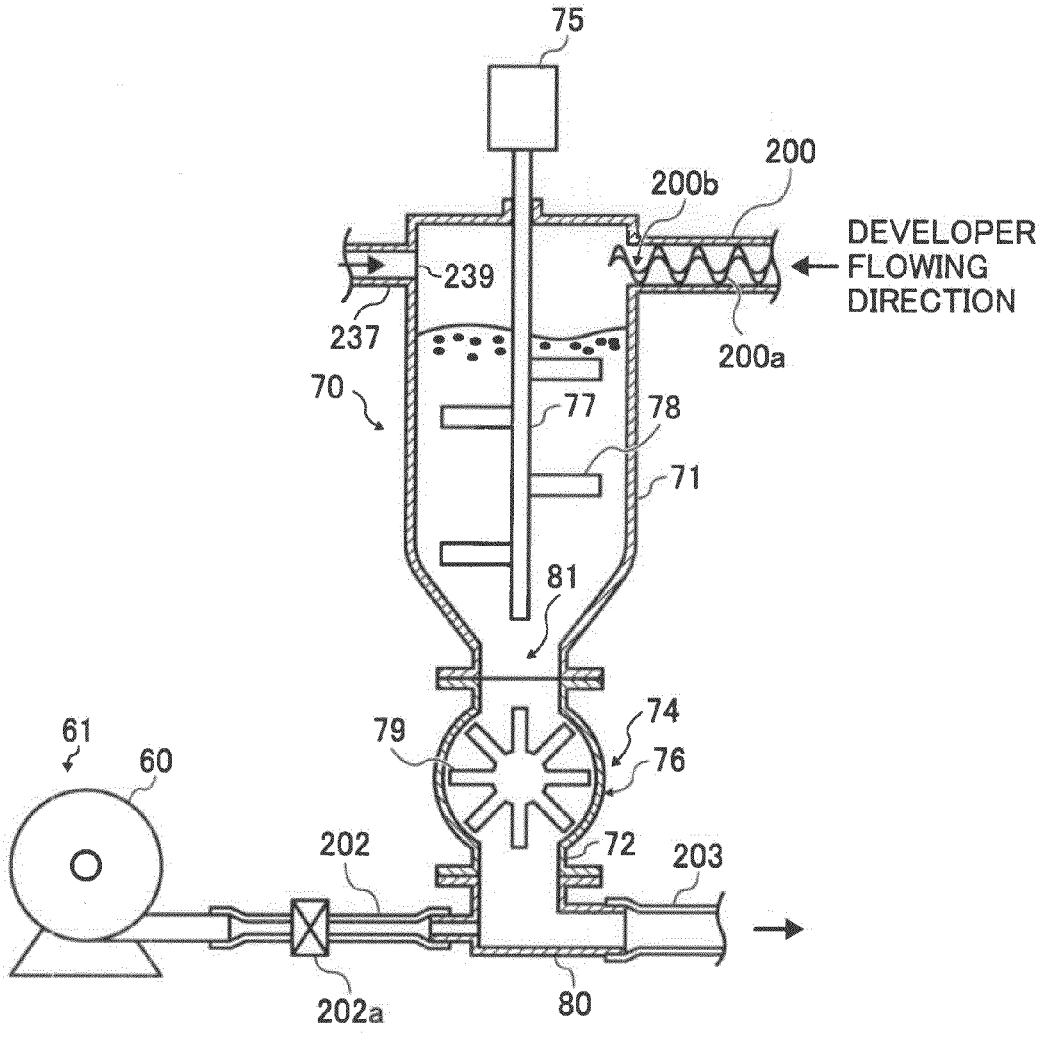
FIG. 17 is a longitudinal cross section of a developer container shown in FIG. 15.

As shown in FIG. 17, the developer conveying unit 200 has a configuration similar to that explained previously for the first and second embodiments.

The developer supply member 203 is, as shown in FIG. 17, a pipe-shaped member connecting the outlet 72 of the agitating device 70 and the supply member 7 of the developing unit 10, and is formed of a material, such as a metal, synthetic resin, or rubber. As shown in FIG. 17, air blown from the transporting unit 61 flows inside the developer supply member 203. With the air blown from the transporting unit 61, the developer discharged from the agitating device 70 is transported to the developing unit 10.

Figure 16:
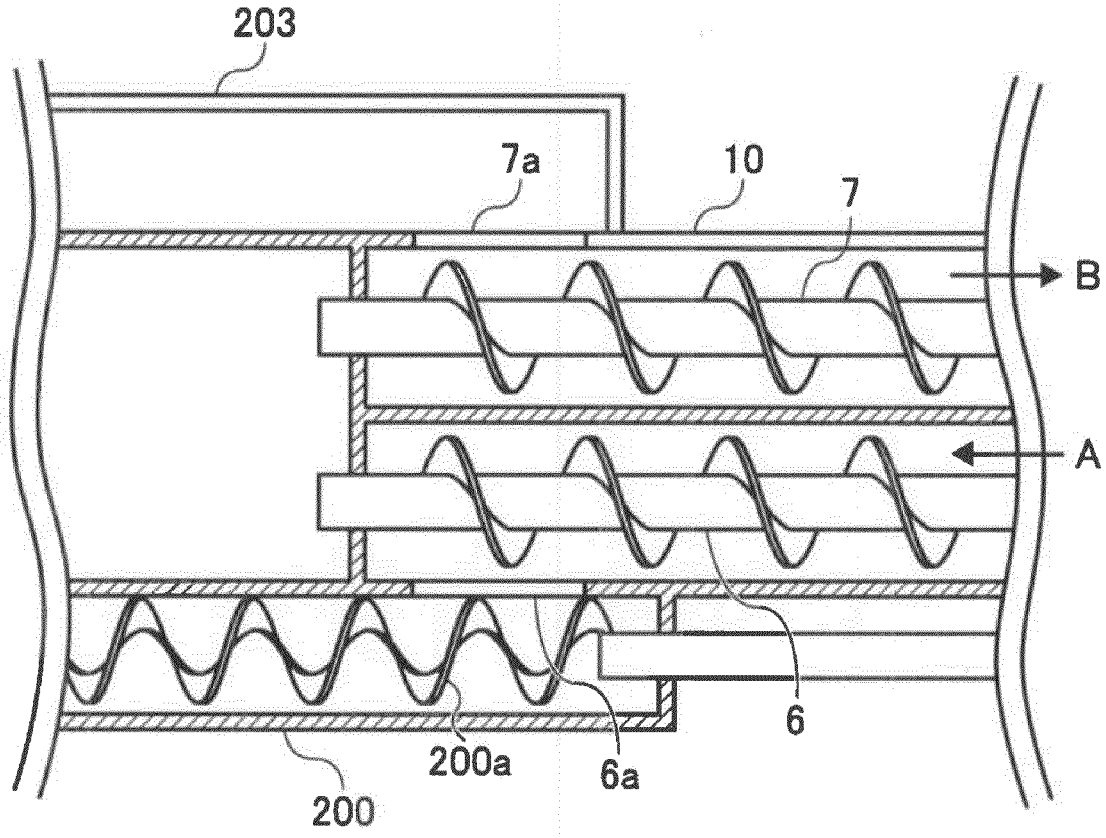
FIG. 16 is a longitudinal side view of a developing unit shown in FIG. 15.

The developing unit 10 is provided with a supply hole **7*a* for supplying the developer from the developer supply member 203 to the supply member 7 and an outlet 6*a* for sending the developer collected by the collecting member 6 to the developer conveying unit 200. In FIG. 16, arrows A and B each indicate a flow of the developer. In more detail, the developer supplied to the developing unit 10 is supplied to the developing roller 11 as being conveyed by the supply member 7 in an arrow B direction in FIG. 16, thereby developing an electrostatic latent image formed on the photosensitive drum 1. The developer after development is collected by the collecting member 6, and is conveyed in an arrow A direction in FIG. 16. Thereafter, the developer is passed to the auger 200*a* of the developer conveying unit 200 from the outlet 6*a*, and is then conveyed to the agitating device 70**.

In the third embodiment, a generally-used auger scheme is used for conveyance from the developing unit 10 to the agitating device 70. Alternatively, air can be used in a manner similar to a conveyance scheme from the agitating device 70 to the developing unit 10. That is, in the third embodiment, the developing unit 10 is positioned upward with respect to the agitating device 70, thereby using air for conveyance from the agitating device 70 to the developing unit 10. In this case, it is not preferable to convey the developer against gravity by using an auger scheme. If conveyance is performed against gravity by using an auger scheme (the same goes for a shaft-provided screw scheme), the developer falls down (flows back) under its own weight, which reduces conveyance efficiency. Moreover, when an auger scheme is used, the curvature of the path of the developer conveying unit 200 cannot be increased, which limits its layout. Furthermore, the developer enters a gap between the inner wall of the developer conveying unit 200 and the auger **200*a*, which is likely to damage the developer. Conversely, when the developer is conveyed from top to bottom, the self weight of the developer in addition to the auger 200*a*** can be used for conveyance. Such conveyance is efficient, and allows the gap between the inner wall of the route and the auger to be ensured to some degree.

The toner supplementing unit 238 supplements toner to the developer conveyed to the developer container 71. As shown in FIGS. 15 and 17, the toner supplementing unit 238 is connected to the agitating device 70 by the pipe-shaped toner supplement member 237. Inside the toner supplement member 237 is a coil screw (not shown), which is driven for rotation by the toner supplement motor 236 to supply toner to the agitating device 70.

In the following, the operation of supplementing toner from the toner supplementing unit 238 to the agitating device 70 is explained in detail.

When a toner image is formed at the developing device and toner is consumed, the density of the toner contained in the developer is decreased. The decrease in toner density is detected by a toner density sensor (not shown) provided inside the developer supply member 203 or the like. To supplement the decreased toner, toner is supplied from the supplementary toner container 235 via the toner supplement member 237 to the agitating device 70. The toner supplied to the agitating device 70 is mixed by an agitator 77 with the developer with a decreased toner density.

Mixing by the agitator 77 damages the developer. In particular, if the developer is contained in advance in the agitating device 70, a large force is required to mix the developer. This problem can be mitigated by supplementing toner into the developer conveying unit 200 that conveys the developer to the agitating device 70 to minimize mixing by the agitator 77. That is, the supplementary toner is mixed to some degree with the developer flowing through the developer conveying unit 200 as being conveyed (sufficient charging is not required). Therefore, the agitating operation of the agitator 77 in the agitating device 70 can be reduced (in that case, the agitator can be omitted).

The agitating device 70 is arranged separately from the developing unit 10, and has a function of making the toner density and the charge amount of the developer appropriate. The agitating device 70 is provided with, as shown in FIG. 17, the developer container 71 that stores the developer, a developer input port 200*b* that is provided at an upper portion of the developer container 71 and has the developer from the developer conveying unit 200 flowing in, and a toner supplement port 239 to which the toner from the toner supplement member 237 flows. The agitating device 70 is provided at its lower portion a flow outlet 81 for letting the developer flow out from the developer container 71 and the outlet 72 from which a predetermined amount of collected developer flowing out of the flow outlet 81 is discharged.

Approximately vertically arranged inside the developer container 71 is the agitator 77 that agitates the developer. The agitator 77 is driven for rotation by the external motor 75. The motor 75 is provided with a control circuit (not shown) for controlling (adjusting) the number of revolutions of the motor. The agitator 77 has mounted thereon a plurality of agitating blades 78 as shown in FIG. 17, agitating the developer by the rotation of the agitating blades 78.

The developer container 71 can be set at an arbitrary position of the machine body. If the capacity is large, a large amount of developer can be stored inside, resulting in prolonging the life of the developer. The control circuit includes a CPU, a ROM, and a RAM. The CPU uses the RAM as a work area and executes a computer program stored in the ROM, thereby implementing the operation of the third embodiment.

The feeder 74 feeds a predetermined amount of developer flowing out from the developer container 71 via the outlet 72 to the developer supply member 203. The feeder 74 is, as shown in FIG. 17, a rotary feeder in which a holder 76 made of metal or resin is provided in its inside a rotor 79 with a plurality of blades. The rotor 79 is rotated by a motor 73 to discharge the developer to an opening in a vertical direction of an inverted-T-shaped receiving pipe member 80 positioned at a lower portion.

The transporting unit 61 transports to the developing unit 10 the developer discharged from the agitating device 70 to the developer supply member 203 and generates an electric charge at the developer being transported. The transporting unit 61 includes, as shown in FIG. 17, the air blower 60 that generates air to be blown to the developer supply member 203 and the pipe-shaped air supply member 202 connecting one opening of the receiving pipe member 80 in a horizontal direction. The air supply member 202 is provided with a throttle valve 202*a*, which is an adjusting unit that adjusts the amount of flow of the air supplied to the receiving pipe member 80 by changing an area of cross section of the path for supplying the air blown from the air blower 60 to the receiving pipe member 80. The other opening of the receiving pipe member 80 in the horizontal direction has connected thereto the developer supply member 203 that supplies the developer to the developing unit 10.

Next, the operation of supplying developer from the agitating device 70 to the developing unit 10 is explained in detail.

The agitating device 70 has developer stored in advance therein, as shown in FIG. 17. As being agitated by the agitator 77, the developer inside the agitating device 70 falls down by its own weight to the feeder 74 from the flow outlet 81. The agitator 77 is not required to be always rotated, but agitates the developer as required, for example, when toner is supplied. The developer that has fallen down to the feeder 74 further falls down to the receiving pipe member 80 by the rotation of the rotor 79. The developer falling down to a receiving pipe member 80 is then transported to the inside of the developer supply member 203 by the air blown from the air blower 60 to enter the developing unit 10 from the supply hole 7*a*.

According to the third embodiment, the developer is agitated in advance at the agitating device 70, whereby the toner and the carrier are mixed before the developer is transported by air via the developer supply member 203 to the developing unit 10. Furthermore, air is blown from the transporting unit 61 via the air supply member 202 to the developer supply member 203, and the air flowing through the developer supply member 203 charges the toner contained in the developer. That is, the air blown from the transporting unit 61 causes the developer to slide or fly inside the developer supply member 203 for sequential transportation. At this time, repeated contacts between developer particles and between developer particles and the inner wall of the developer supply member 203 increase the charge amount of toner contained in the developer.

Explained next is the operation of controlling the charge amount of toner contained in the developer by controlling the flow velocity of air blown from the transporting unit 61.

The charge amount of the toner varies depending on the surrounding environment (temperature and humidity), a decrease in charging capability of the carrier with time, an output image area (a difference in charge amount due to toner retention time), or the like. Therefore, in the developer circulation system disclosed in Japanese Patent Application Laid-Open No. H7-225515, it is difficult to control the charge amount at a constant level.

In the developing device according to the third embodiment, the charge amount can be maintained constant even if external conditions (error conditions) change. Specifically, the developer is transported from the developer supply member 203 by air blown from the air blower 60, and the charge amount of toner contained in the developer increases during transportation. That is, the charge amount of toner contained in the developer changes depending on the air flow velocity. Thus, the charge amount is controlled by changing the air flow velocity.

For example, if the surrounding humidity is high, the charge amount of toner is decreased. To obtain an excellent image, the charge amount has to be increased. Conventionally, a process control (adjusting toner density, developing bias, and charging potential of the photosensitive member by detecting an output image density) is performed to obtain a desired image density as much as possible. However, there are problems of waste time (increase in downtime), provision of stress to the developer due to idling, wasteful toner consumption due to test pattern development for image density detection, and others.

According to the third embodiment, to increase the charge amount of toner contained in the developer, the velocity of air flow inside the developer supply member 203 is increased (the flow amount of air is increased) to increase the charge amount of toner. Conversely, if the surrounding humidity is low, the charge amount of toner contained in the developer is increased. Therefore, the velocity of air flow inside the developer supply member 203 is slowed (the flow amount of air is decreased) to decrease the charge amount of toner.

This principle holds because the density of the developer is changed by the velocity of air flow. That is, when the velocity of air flow inside the developer supply member 203 is slow, the transporting speed of the developer is also slow. On the other hand, since a predetermined amount of developer is discharged from a feeder 50, the developer is transported in a high density state. Accordingly, the opportunities of sliding contacts between developer particles and between developer particles and the inner wall of the path decrease. This suppresses an increase in charge amount of toner contained in the developer. On the other hand, if the velocity of air flow is fast, the density of the developer being transported is low, and also the transporting speed is fast. Accordingly, the opportunities of contacts between developer particles increase, which increases the charge amount of toner.

In this manner, the toner is charged during air transportation. With this, compared with the case of mechanically agitating and charging the developer, which is typified by a conventional agitating machine (strong pressure is exerted among developers to damage the toner), a stress exerted on the developer can be significantly reduced.

As explained above, for controlling the velocity of air flowing through the developer supply member 203, a scheme of changing an input voltage of the air blower 60 as an air supply source or a scheme of adjusting the amount of air by the throttle valve 202*a* provided to the air supply member 202 is used. The velocity of air flow inside the developer supply member 203 can be controlled by the CPU of the control circuit.

When the developer inside the developer supply member 203 is transported through the tube by using air, the operation is greatly influenced by the developer transporting speed, and can be divided into several patterns. That is, (1) when the speed is sufficiently fast, the powder completely flies in the air and flows in an evenly distributed manner. (2) As the speed is gradually decreased, together with the pattern of the flow of the powder as explained in (1), another pattern is mixed in which the powder flows like a liquid as collectively sliding the tube bottom of the developer supply member 203. (3) When the speed is further decreased, the powder flows inside the tube of the developer supply member 203 in a manner as explained in (2). That is, the density of the developer inside the tube of the developer supply member 203 is as (3)>(2)>(1). If the density is large, movement of each developer is restricted (less opportunities of contacts), and therefore, an increase in charge amount is small. Conversely, if the density is small, each developer is easy to move (more opportunities of contacts), and therefore, the charge amount tends to be increased.

The developing device of the third embodiment that charges the toner contained in the developer is effective also in the case where the toner supplement amount from the toner supplementing unit 238 to the agitating device 70 changes. That is, when the toner supplement amount from the toner supplementing unit 238 to the agitating device 70 is large, mixing the toner with the existing developer at the agitating device 70 to increase the charge amount takes time. Therefore, in the developing device, the transporting unit 61 is controlled according to the toner supplement amount from the toner supplementing unit 238 to the agitating device 70 to control the flow velocity of air blown to the developer supply member 203. Thus, the charge amount of toner is increased without taking much time.

The velocity of air flow is determined based on at least one of the following parameters: the amount of supplementary toner, internal machine temperature and humidity, a driving time of the developing device, and an area ratio of an output image. With this, the velocity of air flow is determined by recognizing an external factor that changes the charge amount of toner, which makes the charge amount appropriate more accurately.

Figure 18:
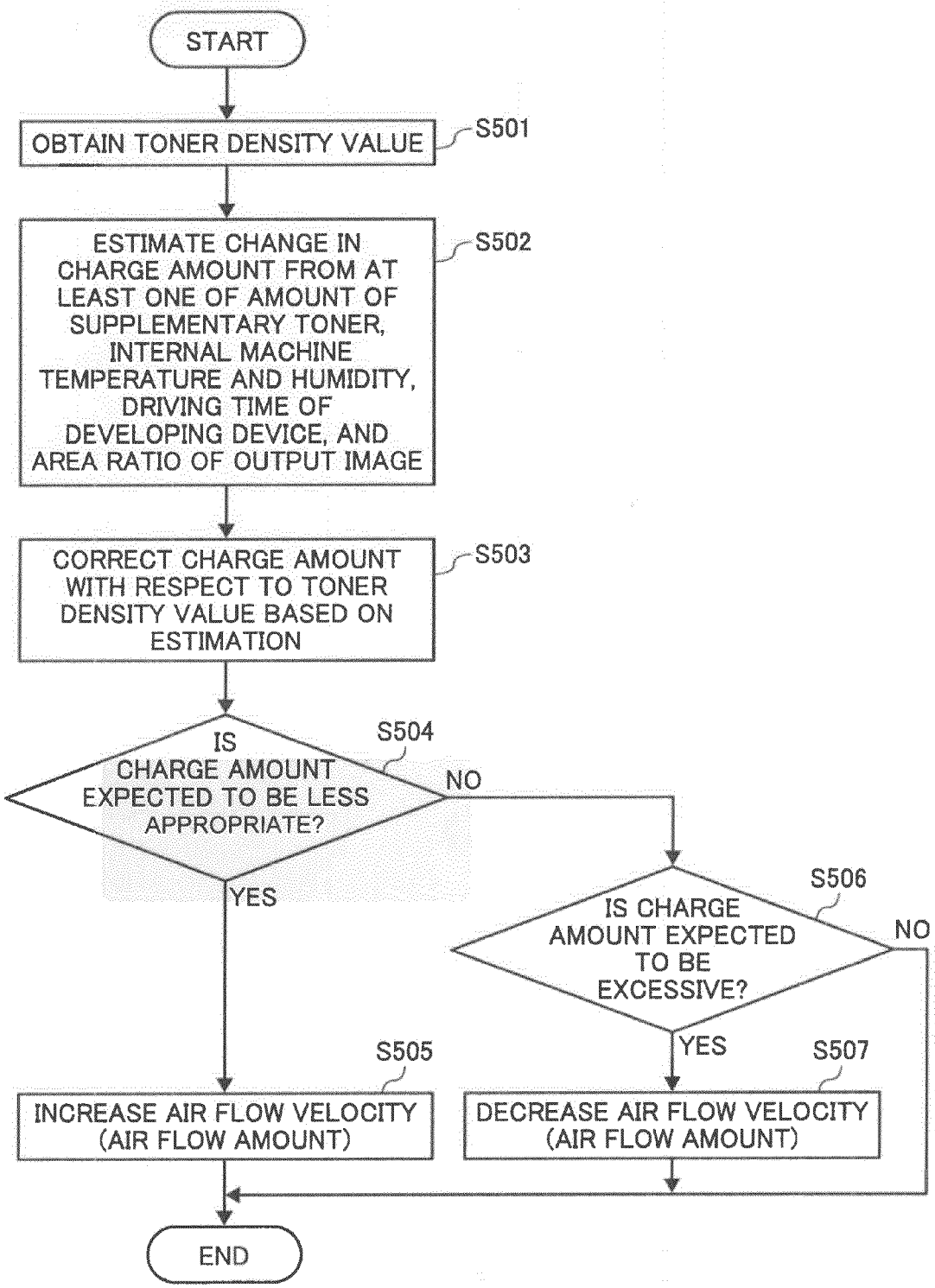
FIG. 18 is a flowchart of a process procedure of controlling a flow velocity of air conveying developer to the developing unit.

FIG. 18 is a flowchart of a process procedure performed by the CPU for controlling the velocity of air flow inside the developer supply member 203.

First, the toner density of the developer measured by a toner density sensor (not shown) is obtained (step S501). Next, from at least one of the parameters: the amount of supplementary toner, internal machine temperature and humidity, the driving time of the developing device, and the area ratio of the output image, a change in charge amount of toner contained in the developer discharged from the agitating device 70 is estimated (step S502). Then, the charge amount of toner with respect to the toner density obtained at step S501 is corrected based on the result obtained at step S502 (step S503).

Next, it is determined whether the corrected charge amount is expected to be less than appropriate (step S504). If the charge amount is expected to be less than appropriate (YES at step S504), the input voltage of the air blower 60 is increased, or the throttle valve 202*a* is gradually opened to increase the velocity of air flowing through the developer supply member 203 (increase the air flow amount) (step S505). If not (NO at step S504), it is determined whether the charge amount is expected to be excessive (step S506). If the charge amount is expected to be excessive, the input voltage of the air blower 60 is decreased, or the throttle valve 202*a* is gradually closed to decrease the velocity of air flowing through the developer supply member 203 (decrease the air flow amount) (step S507). If not (NO at step S506), the process ends.

As explained above, according to the third embodiment, the toner contained in the developer is charged while the developer is transported by using air flowing inside the developer supply member 203. Also, the velocity of air flowing inside the developer supply member 203 is arbitrarily changed to control the charge amount of toner contained in the developer. With this, the charge amount of toner contained in the developer can be maintained constant, and a stable image can be obtained.

Figure 19:
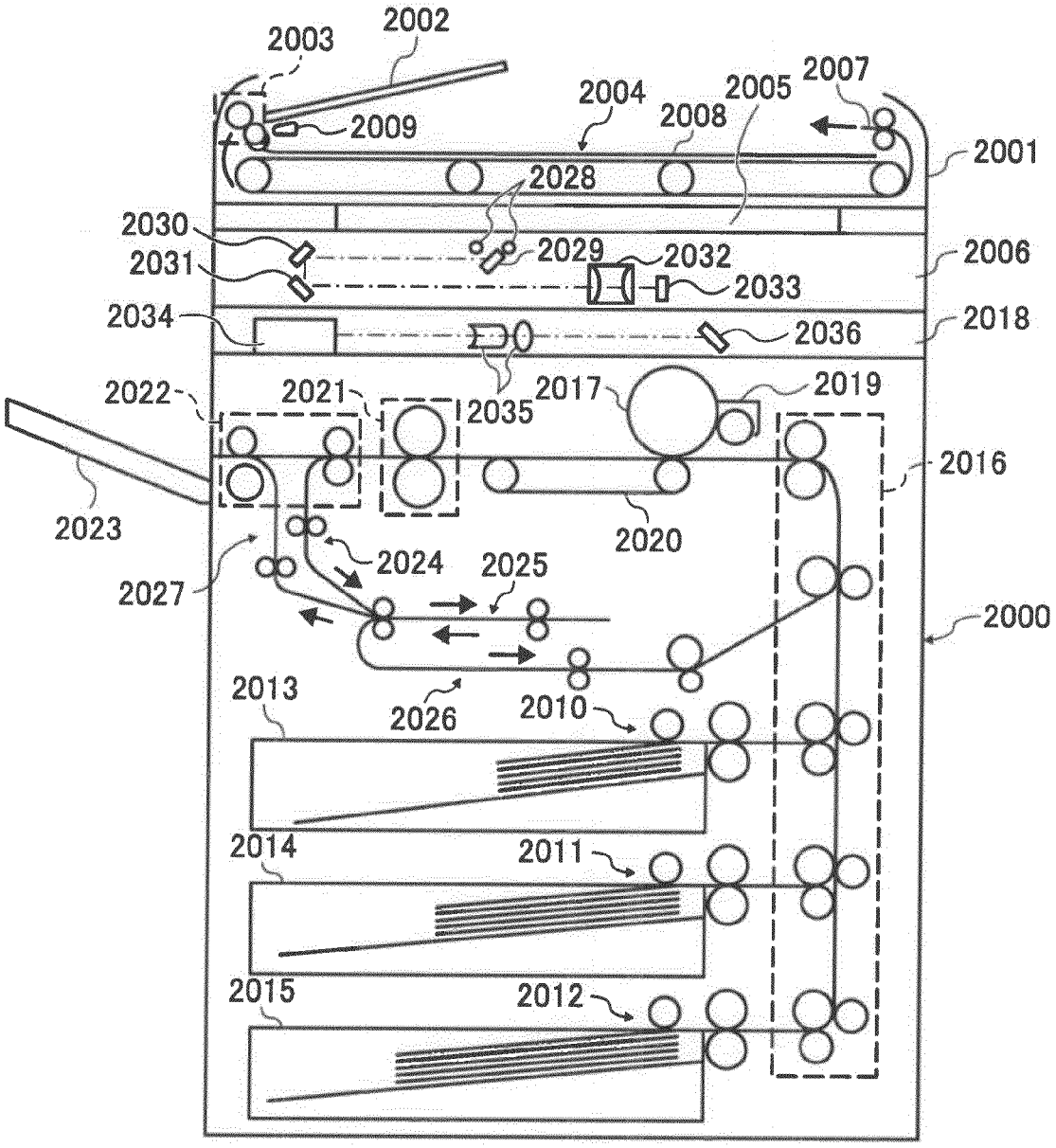
FIG. 19 is a schematic diagram of a monochrome image forming apparatus that includes the developing device according to any one of the embodiments.

FIG. 19 is a schematic diagram of an image forming apparatus that includes the developing device according to any one of the first to third embodiments. This image forming apparatus is exemplarily implemented as an MFP having a copy function and other functions, such as a printer function and facsimile function. In this MFP, a function can be selected by sequentially switching the copy function, the printer function, and the facsimile function with an application switch key on an operating unit (not shown). The MFP is in copy mode at the time of selecting the copy function, in print mode at the time of selecting the printer function, and in facsimile function at the time of selecting the facsimile function.

The image forming apparatus is for monochrome image formation, and basically includes a body 2000, a writing unit 2018 placed on an upper portion of the body 2000, an image reading device 2006 placed on the writing unit 2018, and an automatic document feeding device (ADF) 2001 placed further thereon.

In copy mode, the operation is as follows. The ADF 2001 has a document table 2002 on which a stack of documents is placed with their image surfaces up. When a start key on the operating unit (not shown) is pressed, a document at the bottom is fed by feeding rollers 2003 and a feeding belt 2004 to a predetermined position on a document table formed of a contact glass 2005. The ADF 2001 has a function of counting up the number of documents each time feeding of one document is completed. The document on the contact glass 2005 is delivered onto a delivery table 2008 by the feeding belt 2004 and delivery rollers 2007 after image information is read by the image reading device 2006.

When it is detected by a document set detector 2009 that the next document is present on the document table 2002, the document at the bottom on the document table 2002 is similarly fed by the feeding rollers 2003 and the feeding belt 2004 to the predetermined position on the contact glass 2005. These feeding rollers 2003, the feeding belt 2004, and the delivery rollers 2007 are driven by a conveyor motor (not shown).

The image reading device 2006 includes an optical system and an optical/electrical converting device. The optical system includes a lens unit 2032 in which the document on the contact glass 2005 is radiated with two lamps 2028 for line scanning the image information on the document in a sub-scanning direction, and reflected light is reflected as image data by a first mirror 2029, a second mirror 2030, and a third mirror 2031 to a predetermined direction to form a reduced image. The image is formed on an image formation surface of a charge-coupled device (CCD) image sensor 2033. The optical/electrical converting device includes an image reading circuit (not shown) including the CCD image sensor 2033, and generates image data required for image formation from a signal converted by the CCD image sensor 2033 to an electrical signal.

The image data output from the image reading device 2006 is modulated by an image processing unit (not shown), and is then written on a photosensitive drum 2017 by the writing unit 2018 to form an electrostatic latent image. The writing unit 2018 includes a laser light emitting device 2034, an fθ lens 2035, a reflection mirror 2036, and others. Although laser light is used as an exposure light source, this is not meant to be restrictive. For example, a light-emitting diode (LED) array can be used.

The body 2000 includes the photosensitive drum 2017, a developing unit 2019, a fixing unit 2021, a delivery unit 2022, first to third feeding devices 2010 to 2012, a vertical conveying unit 2016, and others.

The photosensitive drum 2017 is uniformly charged by a charger (not shown), is exposed with optical information from the writing unit 2018, and then has formed thereon an electrostatic latent image. The electrostatic latent image on the photosensitive drum 2017 is developed by the developing unit 2019 to be a toner image.

Under the photosensitive drum 2017 is arranged a conveyor belt 2020. The conveyor belt 2020 conveys and transfers a transfer sheet as a recording medium. With a transfer bias being applied from a power supply (not shown), the conveyor belt 2020 conveys the transfer sheet from the vertical conveying unit 2016 at a speed identical to that of the photosensitive drum 2017, whereby the toner image is transferred from the photosensitive drum 2017 onto the transfer sheet. The toner image on the transfer sheet is fixed by the fixing unit 2021, and the transfer sheet is then delivered by the delivery unit 2022 onto a delivery tray 2023. The photosensitive drum 2017 is cleaned by a cleaning device (not shown) after the toner image is transferred. The photosensitive drum 2017, the charger, the writing unit 2018, the developing unit 2019, and the transferring unit constitute an image forming unit that forms an image on a transfer sheet based on image data. The photosensitive drum 2017 is driven by a main motor for rotation at a constant speed.

The delivery unit 2022 is provided with a both-side conveying path. That is, there are arranged a reversing unit 2025 to which the transfer sheet is fed by paired conveyor rollers 2024 in the middle of the delivery unit 2022, an image-formation-side conveying path 2026 through which the transfer sheet reversed by the reversing unit 2025 is conveyed again to the vertical conveying unit 2016 side, and a delivery conveying path 2027 through which the reversed transfer sheet is again returned to the delivery unit 2022 side. With this both-side conveying path, the transfer sheet can be delivered to the delivery tray 2023 with images formed on both sides of the transfer sheet or with the side on which an image is formed facing down.

The first feeding device 2010, the second feeding device 2011, and the third feeding device 2012 as feeding units feed transfer sheets stacked on a first tray 2013, a second tray 2014, and a third tray 2015, respectively, when selected. The transfer sheet is conveyed by the vertical conveying unit 2016 to a position where the transfer sheet abuts on the photosensitive drum 2017.

In print mode, external image data is input to the writing unit 2018 in place of image data from the image processing unit, and then an image is formed by the image forming unit on a transfer sheet. In facsimile mode, image data from the image reading device 2006 is transmitted by a facsimile transmitting and receiving unit (not shown) to the party at the other end, and image data from the party at the other end is received by the facsimile transmitting and receiving unit and is then input to the writing unit 2018 in place of the image data from the image processing unit. Thus, an image is formed on the transfer sheet by the image forming unit.

Figure 20:
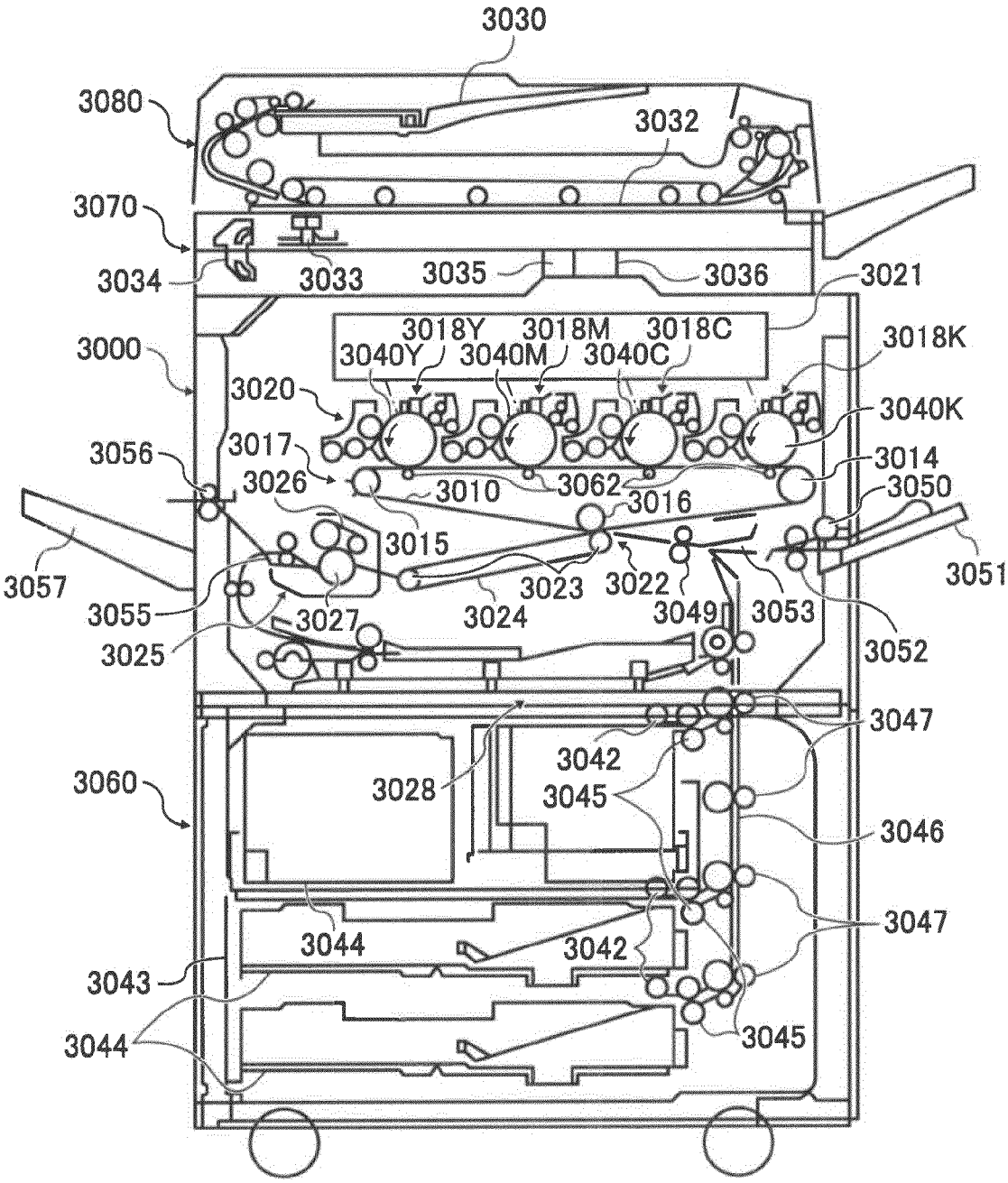
FIG. 20 is a schematic diagram of a tandem-type digital multifunction product (MFP) that includes the developing device according to any one of the embodiments.

FIG. 20 is a schematic diagram of a digital MFP as an image forming apparatus that includes the developing device according to any one of the first to third embodiments. The digital MFP includes a digital MFP body 3000, a feeding table 3060, a scanner 3070, and an automatic document feeding device (ADF) 3080. The digital MFP body 3000 is placed on the feeding table 3060, and the scanner 3070 is mounted on the digital MFP body 3000. The ADF 3080 is set further thereon to supply a document to the scanner 3070.

At the center of the digital MFP body 3000, an intermediate transfer belt 3010 of an endless belt type is wound around first, second, and third supporting rollers 3014, 3015, and 3016, and is capable of rotational conveyance in a clockwise direction in FIG. 20. At the left of the second supporting roller 3015 among three supporting rollers, an intermediate-transfer-member cleaning device 3017 is provided that removes residual toner left on the intermediate transfer belt 3010 after image transfer.

Also, above the intermediate transfer belt 3010 stretched between the first supporting roller 3014 and the second supporting roller 3015, four image forming units 3018Y, 3018C, 3018M, and 3018K for forming single-color images of yellow (Y), cyan (C), magenta (M), and black (K), respectively, are horizontally arranged along a conveying direction of the intermediate transfer belt 3010, thereby constituting a tandem-type image forming unit 3020. Above the image forming unit 3020, an exposing device 3021 is further provided, as shown in FIG. 20. Note that alphabets provided after reference numerals represent color; Y is for yellow, C is for cyan, M is for magenta, and K is for black.

On the other hand, a secondary transferring device 3022 is provided on a side opposite to the image forming unit 3020 across the intermediate transfer belt 3010. The secondary transferring device 3022 is configured in this example by winding a secondary transfer belt 3024, which is an endless belt extending around two rollers 3023 and is pressed onto the third supporting roller 3016 via the intermediate transfer belt 3010, and transfers an image on the intermediate transfer belt 3010 onto a transfer sheet.

On a downstream side of the secondary transferring device 3022 in a transfer sheet conveying direction, a fixing device 3025 that fixes the transferred image on the transfer sheet is provided. The fixing device 3025 is configured in a manner such that a pressure roller 3027 is pressed onto a fixing belt 3026, which is an endless belt. The secondary transferring device 3022 also has a transfer-sheet conveying function of conveying a transfer sheet after image transfer to the fixing device 3025. As a matter of course, a transfer roller and a non-contact charger may be arranged as the secondary transferring device 3022. In such cases, however, it is difficult to provide this transfer-sheet conveying function.

Under the secondary transferring device 3022 and the fixing device 3025, a transfer-sheet reversing device 3028 is provided in parallel to the image forming unit 3020. The transfer-sheet reversing device 3028 reverses the transfer sheet so that images are recorded on both sides of the transfer sheet.

When copying is performed by using this color copier, a document is set on a document table 3030 of the ADF 3080, or the ADF 3080 is opened to set a document on a contact glass 3032 of the scanner 3070 and is then closed and pressed.

With a press of a start switch (not shown), after the document is conveyed onto the contact glass 3032 if the document is set on the ADF 3080, or after the document is set on the contact glass 3032, the scanner 3070 is immediately driven, whereby a first running member 3033 and a second running member 3034 start running. The document is radiated with light from the light source at the first running member 3033, and the light is reflected from the document surface toward the second running member 3034. The reflected light is reflected by a mirror of the second running member 3034, and then enters a reading sensor 3036 through an image forming lens 3035. Thus, the scanner 3070 reads the document.

Also, when the start switch is pressed, a driving motor drives the first supporting roller 3014, which is a driving roller, for rotation. On the other hand, the intermediate transfer belt 3010 is stretched between the first supporting roller 3014 with a predetermined tension and the remaining two driven rollers, i.e., the second and third supporting rollers 3015 and 3016. Therefore, these remaining rollers are rotated by receiving a rotational driving force from the first supporting roller 3014. At the same time, photosensitive drums 3040Y, 3040C, 3040M, and 3040K of the respective colors corresponding to the image forming units 3018Y, 3018C, 3018M, and 3018K are rotated. On the photosensitive drums 3040, single-color images of yellow, cyan, magenta, and black are formed respectively. Then, with the conveyance of the intermediate transfer belt 3010, these single-color images are sequentially transferred by an initial transferring device 3062, thereby forming a combined color image on the intermediate transfer belt 3010.

On the other hand, when the start switch is pressed, one of feeding rollers 3042 of the feeding table 3060 is selected for starting rotation. Then, transfer sheets are drawn out from one of feeding cassettes 3044 provided in a multistage manner to a sheet bank 3043. The drawn-out transfer sheets are separated one by one by a separation roller 3045 to enter a feeding path 3046, and are conveyed by conveyor rollers 3047 to be guided to a feeding path in the copier body (digital MFP body 3000). The transfer sheet is then bumped against registration rollers 3049 to be stopped, where a skew is corrected and feeding timing is adjusted. Another feeding scheme is manual feeding. In manual feeding, a feeding roller 3050 may be rotated to draw transfer sheets on a bypass tray 3051, the transfer sheets may be separated one by one by a separation roller 3052 to be conveyed to a bypass path 3053, and then the transfer sheet may be similarly bumped against the registration rollers 3049 to be stopped.

The registration roller 3049 rotates in conformity with the combined color image on the intermediate transfer belt 3010 to feed the transfer sheet to a nip between the intermediate transfer belt 3010 and the secondary transferring device 3022. The color image is then transferred onto the transfer sheet by the secondary transferring device 3022.

The transfer sheet after image transfer is fed by the secondary transferring device 3022 to the fixing device 3025. At the fixing device 3025, heat and pressure are applied to fix the transferred image. Then, the transfer sheet is switched by a switching nail 3055 to be delivered by delivery rollers 3056 onto a delivery tray 3057 for stacking. At this time, with the switching by the switching nail 3055, the transfer sheet can be conveyed to the transfer-sheet reversing device 3028, where the transfer sheet is reversed to be guided again to the transfer position where an image is recorded also on the back, and then be delivered by the delivery rollers 3056 onto the delivery tray 3057.

On the other hand, as for the intermediate transfer belt 3010 after image transfer, residual toner left on the intermediate transfer belt 3010 after image transfer is removed by the intermediate-transfer-member cleaning device 3017 for preparation for image formation again by the tandem image forming unit 3020. The registration rollers 3049 are generally used as being grounded, and is applied with a bias for removing dust from the transfer sheet.

In the image forming unit 3020, the image forming units 3018Y, 3018C, 3018M, and 3018K each have the initial transferring device 3062 arranged at a position where the device faces a relevant one of the photosensitive drums 3040Y, 3040C, 3040M, and 3040K across the intermediate transfer belt 3010. Although not shown in FIG. 1, as with the conventional technology, these photosensitive drums 3040Y, 3040C, 3040M, and 3040K are surrounded by image-forming components, such as a charging device, a developing device, a photosensitive cleaning device, and a static eliminating device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a developing unit that develops an electrostatic latent image on an image carrier with a developer containing toner and carrier;

a developer agitating unit that agitates the developer;

a developer conveying unit that connects the developing unit and the developer agitating unit, and conveys the developer from the developing unit to the developer agitating unit;

a developer supplying member to supply the developer dropped from the developer agitating unit to the developing unit by a flow or air;

a holder provided between the developer agitating unit and the developer supplying member, inside which a rotating member is provided that rotates a shaft member on which a plurality of blades are provided, the rotating member, while rotating, receives the developer among the blades so as to be dropped; and a member having a path extending in the vertical direction from the holder, and a path extending in the horizontal direction to the developer supplying member, wherein the developer drops down through the path extending in the vertical direction into the path extending in the horizontal direction, and the developer is supplied through the path extending in the horizontal direction by said flow of air.

2. The developing device according to claim 1, further comprising:

an air supplying unit that supplies the flow of air to a place to which the developer drops from the rotating member.

3. The developing device according to claim 2, wherein the air supplying unit is located downstream of the holder and is connected to the path extending in the horizontal direction.

4. The developing device according to claim 1, wherein the rotating member is provided at a lower portion of the developer agitating unit.

5. The developing device according to claim 1, further comprising an adjusting unit that adjusts an amount of the flow of air.

6. The developing device according to claim 1, wherein the developer is provided at an upper position of the developer agitating unit.

7. An image forming apparatus that is provided with the developing device according to claim 1.

8. A developing device comprising:

a developing unit that develops and electrostatic latent image on an image carrier with a developer containing toner and carrier;

a developer agitating unit that agitates the developer;

a developer conveying unit that connects the developing unit and the developer agitating unit, and conveys the developer from the developing unit to the developer agitating unit;

a discharging unit that discharges the developer from the developer agitating unit;

a developer supplying member to supply the developer dropped from the developer agitating unit to the developing unit by a flow of air;

a member having a path extending in the vertical direction from the discharging unit, and a path extending in the horizontal direction to the developer supplying member, wherein the developer drops down through the path extending in the vertical direction into the path extending in the horizontal direction, and the developer is supplied through the path extending in the horizontal direction by the flow of air.

9. The developing device according to claim 8, further comprising:

an air supplying unit that supplies the flow of air to a place to which the developer drops from the discharging unit.

10. The developing device according to claim 9, wherein the discharging unit is provided at a lower portion of the developer agitating unit.

11. The developing device according to claim 10, wherein the discharging unit includes a holder inside which a rotating member is provided that rotates a shaft member on which a plurality of blades are provided, and the rotating member, while rotating, receives the developer among the blades so as to be dropped.

* * * * *